United States Patent [19]

Taniguchi et al.

[11] Patent Number: 4,970,131

[45] Date of Patent: Nov. 13, 1990

[54] ELECTROPHOTOGRAPHIC PHOTOCONDUCTOR HAVING OVERCOAT LAYER

[75] Inventors: Kiyoshi Taniguchi; Toshio Fukagai; Kayoko Yokoyama, all of Numazu, Japan

[73] Assignee: Ricoh Company, Ltd., Tokyo, Japan

[21] Appl. No.: 395,091

[22] Filed: Aug. 16, 1989

[30] Foreign Application Priority Data

| | | | |
|---|---|---|---|
| Aug. 29, 1988 | [JP] | Japan | 63-214553 |
| Aug. 29, 1988 | [JP] | Japan | 63-214555 |
| Sep. 16, 1988 | [JP] | Japan | 63-231783 |
| Sep. 16, 1988 | [JP] | Japan | 63-231784 |

[51] Int. Cl.[5] ..... G03G 5/14

[52] U.S. Cl. ..... 430/67; 430/66

[58] Field of Search ..... 430/66, 67

[56] References Cited

U.S. PATENT DOCUMENTS 4,006,020 2/1977 Polastri ..... 430/67

*Primary Examiner*—J. David Welsh

*Attorney, Agent, or Firm*—Oblon, Spivak, McClelland, Maier & Neustadt

[57] ABSTRACT

An electrophotographic photoconductor is disclosed, which comprises an electroconductive support, a photoconductive layer formed on the electroconductive support, and an overcoat layer formed on the photoconductive layer, in which the overcoat layer comprises a binder resin and one component selected from the group consisting of a crown ether, a polyalkylene glycol, a polyalkylene glycol ester and a polyalkylene glycol ether. The overcoat layer may be composed of an intermediate layer formed on the photoconductive layer, and a protective layer formed on the intermediate layer in such a manner that any of the crown ether and polyalkylene glycol derivatives is contained in the intermediate layer.

45 Claims, No Drawings

ELECTROPHOTOGRAPHIC PHOTOCONDUCTOR HAVING OVERCOAT LAYER

BACKGROUND OF THE INVENTION

1. Field of the Invention

This invention relates to an improved electrophotographic photoconductor.

2. Discussion of Background

Recently, organic photoconductive materials, which are relatively inexpensive and cause no enviromental pollution, have been widely used as photoconductors of electrophotographic copying machines.

As an organic electrophotographic photoconductor, there have been known photoconductive resin type photoconductors, typically a photoconductor comprising polyvinyl carbazole (PVK), charge-transport complex type photoconductors, typically a photoconductor comprising polyvinyl carbazole 2,4,7-trinitro-fluorenone (PVK-TNF), pigment-dispersed type photoconductors, typically a photoconductor in which phthalocyanine is dispersed in a binder resin, and function-separated type photoconductors such as a photoconductor consisting essentially of a charge-generating material and a charge-transporting material. Of these, the last one is currently attracting much attention.

When a high-photosensitive photoconductor of the function-separate type is applied to the Carlson process, it exhibits low chargeability and weak electric charge retention (large dark decay). Furthermore, the chargeability and electric charge retention properties are drastically deteriorated in the course of repeated and continuous use, causing uneven image density and fogging. In addition, toner particles are unfavorably deposited on the background when reverse development is performed.

In general, the chargeability of the high photo-sensitive photoconductor is reduced due to pre-exposure fatigue. Such fatigue is chiefly caused by the light absorbed by the charge-generating material contained in the photoconductor. It is therefore considered that the longer the period in which the electric charges generated by the light absorption remain in a migrational state in the photoconductor and the greater the number of the generated electric charges, the greater the reduction in the chargeability of the photoconductor. Even if the photoconductor is electrically charged while the electric charges generated by light-absorption are in a residual state, the surface potential will not be elevated until the residual electric charges are dissipated. This is because the electric charges at the surface of the photoconductor are neutralized with the residual carriers which migrate in the photoconductor. The rise of surface potential is thus delayed corresponding to the pre-exposure fatigue, so that the apparent surface potential is lowered.

In an attempt to overcome the above shortcomings in the prior art, the following protective layers have been proposed: a protective layer in which aluminous fibers are dispersed as disclosed in Japanese Laid-Open Pat. Application 55-45024; protective layers in which $Al_2O_3$, $SiO_2$, SiC, $SiO_2$ $Al_2O_3$ 3 and B4C are each dispersed as disclosed in Japanese Laid-Open Pat. Applications 56-38054, 56-99347 and 57-165848; a protective layer in which $SnO_2$ and $Sb_2O_3$ are dispersed as disclosed in Japanese Laid-Open Pat. Application 58-121044; a protective layer in which CuI is dispersed as disclosed in Japanese Laid-Open Pat. Application 59-159; a protective layer in which $TiO_2$ is dispersed as disclosed in Japanese Laid-Open Pat. Application 60-75842; protective layers in which indium oxide is dispersed as disclosed in Japanese Laid-Open Pat. Applications 57-30846 and 57-154250; and a protective layer coated with $MgF_2$, $SiN_4$, $Al_2O_3$ or $ZrO_2$ by means of sputtering as disclosed in Japanese Laid-Open Pat. Application 58-59459.

Furthermore, the following intermediate layers have also been proposed: an intermediate layer in which an organic titanium compound is dispersed as disclosed in Japanese Laid-Open Pat. Application 58-18637; intermediate layers in which organic metallic compounds are dispersed as disclosed in Japanese Laid-Open Pat. Applications 58-60748 and 59-46653; an intermediate layer in which zirconium alkoxide or zirconium alkoxide with a silane coupling agent is dispersed as each disclosed in Japanese Laid-Open Pat. Applications 59-223438 and 58-121043; intermediate layers in which thermoplastic polycarbonate resin, acrylate resin and methacrylate resin are each dispersed as disclosed in Japanese Laid-Open Pat. Applications 60-12552, 60-142341 and 60-117561.

The above-mentioned protective layers and intermediate layers, however, cannot sufficiently prevent the reduction in chargeability caused by the repeated and continuous use of the photoconductors, the delay in the rise of the surface potential thereof, or the considerable change in the residual electric potential.

SUMMARY OF THE INVENTION

It is therefore an object of the present invention to provide an improved electrophotographic photoconductor which is highly sensitive, shows extremely small reduction in the chargeability caused by pre-exposure fatigue, and exhibits no delay in the rise of the charged potential and minimal changes in the residual electric potential even after extended periods of repeated charging and exposing.

The foregoing object of the present invention can be attained by an electrophotographic photoconductor comprising an electroconductive support, a photoconductive layer formed on the electroconductive support, and an overcoat layer formed on the photoconductive layer, wherein the overcoat layer comprises a binder resin and one component selected from the group consisting of a crown ether, a polyalkylene glycol, a polyalkylene glycol ester, and a polyalkylene glycol ether.

DETAILED DESCRIPTION OF THE PREFERRED EMBODIMENTS

In the present invention, the overcoat layer, which is a single layer and serves as a protective layer, is formed on the photoconductive layer, and a crown ether, polyalkylene glycol, polyalkylene glycol ester or polyalkylene glycol ether is incorporated therein.

The overcoat layer can also be made of two layers which are an intermediate layer formed on the electroconductive support and a protective layer formed on the intermediate layer. In this case, one of the above crown ester and polyalkylene derivatives is incorporated into the intermediate layer.

Thus, the electrophotographic photoconductor of the present invention comprises a crown ether, polyalkylene glycol, polyalkylene glycol ester or polyalkylene glycol ether in the overcoat layer or the intermediate layer, so that the degree of reduction in the chargeability after repeated and continuous use, the delay in the rise of the surface potential and the change in the residual electric potential can be effectively minimized.

In the present invention, it is preferably to employ a crown ether containing 3 t 8 oxygen atoms in its ring. Examples of such crown ethers are as follows:

benzo-9-crown-3-ether,

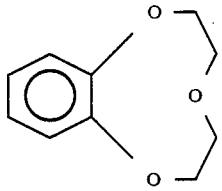

12-crown-4-ether,

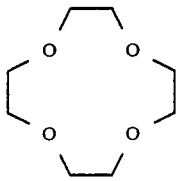

18-crown-6-ether,

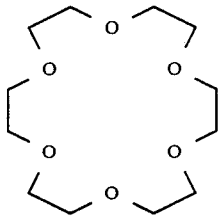

dibenzo-18-crown-6-ether

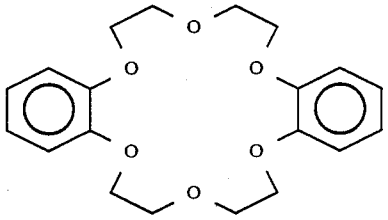

tribenzo-18-crown-6-ether,

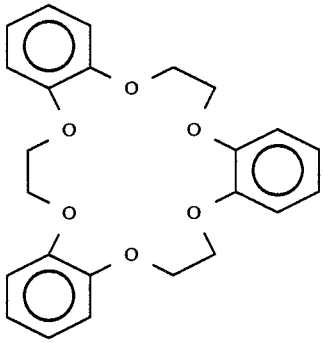

dicyclohexano-18-crown-6-ether,

-continued

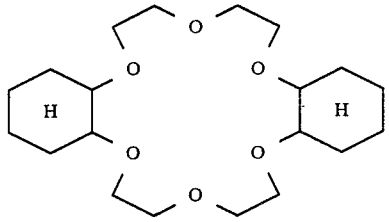

tetrabenzo-24-crown-8-ether,

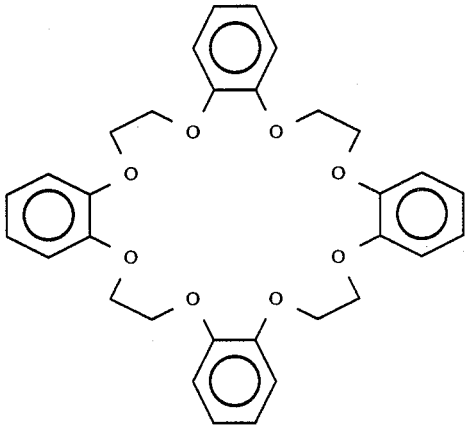

15-crown-5-ether

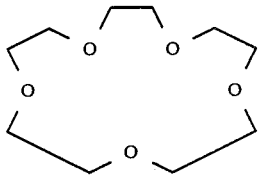

21-crown-7-ether

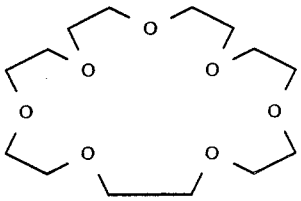

benzo-15-crown-5-ether,

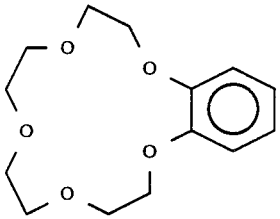

dibenzo-24-crown-8-ether,

-continued

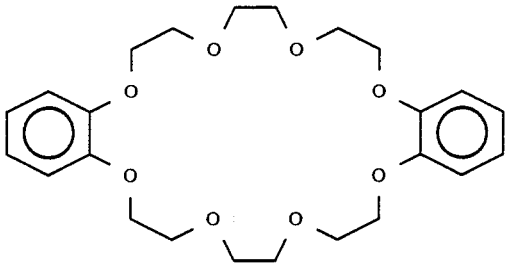

dicyclohexano-24-crown-8-ether,

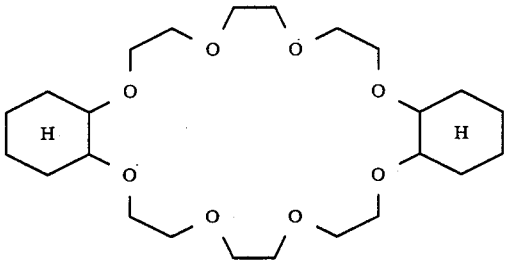

poly(dibenzo-18-crown-6-ether), and

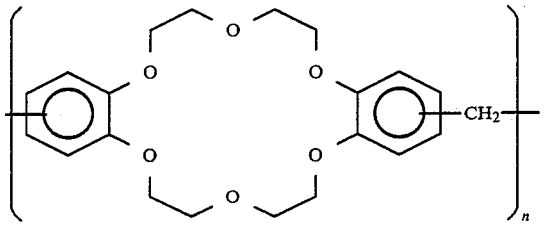

a crown ether having the following formula

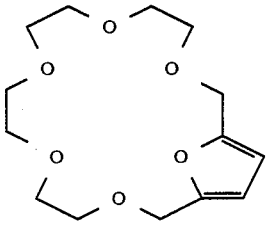

When the crown ether is incorporated into the overcoat layer, it is used in an amount of 0.01 to 10 parts by weight, preferably 0.1 to 1 parts by weight, per 1 part by weight of the binder resin contained in the overcoat layer. When the crown ether is incorporated into the intermediate layer, it is used in an amount of 0.1 to 50 parts by weight, preferably 0.2 to 20 parts by weight, per 100 parts by weight of the binder resin contained in the intermediate layer.

Examples of the polyalkylene glycols used in the present invention include polyethylene glycols, polypropylene glycols, polybutylene glycols, and random copolymers and block copolymers of hydroxyethylene and hydroxypropylene. Commercially available polyalkylene glycols of the above types can be used in the present invention.

Regarding the polyethylene glycols, those having a molecular weight ranging from 100 to 5,000,000, preferably from 200 to 50,000, are employed in the present invention. (Those having a molecular weight of 10,000 or more may be referred to as polyethylene oxide.)

With respect to the polypropylene glycols, those having a molecular weight ranging from 130 to 500,000, preferably from 500 to 10,000, are employed.

In the case of the polybutylene glycols, those having a molecular weight ranging from 160 to 100,000, preferably from 500 to 3,000, are employed.

Regarding the random and block copolymers of hydroxyethylene and hydroxypropylene, those having a molecular weight ranging from 200 to 500,000, preferably from 500 to 50,000, and a mean number of added moles of an oxyethylene group of 0.1 to 99.9 mol% are employed.

Specific examples of the polyalkylene glycols which are preferably employed in the present invention include polyethylene glycol monocarboxylic acid esters, polyethylene glycol dicarboxylic acid esters, and carboxylic acid esters of polyoxyethylene sorbitan.

Examples of the commercially available polyethylene glycol monocarboxylic acid esters usable in the present invention are as follows:

"Ionet MS-400", "Ionet MS-1000", "Ionet MO-200", "Ionet MO-400, "Ionet MO-600" and "Santopearl TE-106" (Trademarks), all available from Sanyo Chemical Industries, Ltd.;

"Noigen ES" (Trademark) series, available from Dai-Ichi Kogyo Seiyaku Co., Ltd.; and "Nonion L" (Trademark) series, "Nonion S" (Trademark) series, "Nonion O" (Trademark) series and "Nonion T" (Trademark) series, all available from Nippon Oil & Fats Co., Ltd.

Examples of the commercially available polyethylene glycol dicarboxylic acid esters usable in the present invention are as follows:

"Ionet DL-200", "Ionet DS-300", "Ionet DS-400", "Ionet DO-200", "Ionet DO-400", "Ionet DO-600", "Ionet DO-1000" and "Santopearl GE-70" (Trademarks), all available from Sanyo Chemical Industries, Ltd.; and "Nonion DS-60HN" (Trademark) (distearate), available from Nippon Oil & Fats Co., Ltd.

Examples of the commercially available carboxylic acid esters of polyethylene sorbitan usable in the present invention are as follows:

"Tween" (Trademark), available from Atlas Powder Corp.;

"Ionet T-20C", "Ionet T-60C" and "Ionet T-80C" (Trademarks), all available from Sanyo Chemical Industries, Ltd.;

"Adeka Estol T-62" and "Adeka Estol T-82" (Trademarks), both available from Asahi Denka Kogyo K.K.;

"Sorgen TW" (Trademark) series, available from Dai-Ichi Kogyo Seiyaku Co., Ltd.; and "Nonion LT-221", "Nonion PT-221", "Nonion ST-221" and "Nonion OT-221" (Trademarks), all available from Nippon Oil & Fats Co., Ltd.

Specific examples of the polyalkylene glycol ethers used in the present invention include polyethylene glycol monoethers, polypropylene glycol monoethers and monoethers of copolymers of hydroxyethylene and hydroxypropylene. Commercially available polyalkylene glycol monoethers of the above type can be employed in the present invention.

The polyethylene glycol monoether is represented by the following formula:

$$R-O-(CH_2CH_2O)_n H$$

wherein R represents an alkyl group having 1 to 30 carbon atoms, preferably 10 to 20 carbon atoms, a substituted or unsubstituted aryl group, or most preferably a phenyl group substituted with an alkyl group having 1 to 20 carbon atoms, and n represents the mean number of added moles of a hydroxyethlene group, which is an integer of 1 or more, preferably 2 to 1000.

Examples of commercially available polyethylene glycol monoethers having the above formula are as follows:

"Emulmin 40", "Emulmin 50", "Emulmin 60", "Emulmin 70", "Emulmin 110", "Emulmin 140", "Emulmin 180", "Emulmin M-20", "Emulmin 240", "Emulmin L-90-S", "Emulmin L-380", "Nonipol 20", "Nonipol 30", "Nonipol 40", "Nonipol 55", "Nonipol 60", "Nonipol 70", "Nonipol 85", "Nonipol 91", "Nonipol 95", "Nonipol 100", "Nonipol 110", "Nonipol 120", "Nonipol 130", "Nonipol 140", "Nonipol 160", "Nonipol 200", "Nonipol 290", "Nonipol 300", "Nonipol 400", "Nonipol 450", "Nonipol 500", "Nonipol 700", "Nonipol 800", "Nonipol D160", "Octapol 45", "Octapol 50", "Octapol 60", "Octapol 80", "Octapol 100", "Octapol 200", "Octapol 300", "Octapol 400", "Dodecapol 61", "Dodecapol 90", "Dodecapol 120" and "Dodecapol 200" (Trademarks), all available from Sanyo Chemical Industries, Ltd.;

"Adeka Estol OEG" (Trademark) series and "Adeka Estol SEG" (Trademark) series, all available from Asahi Denka Kogyo K.K.;

"Noigen ET" (Trademark) series, "Noigen EA" (Trademark) series, "Emulsit L" (Trademark) series, and "Emulsit" (Trademark) series, all available from Dai-Ichi Kogyo Seiyaku Co., Ltd.; and "Nonion E-206", "Nonion E-215", "Nonion E-230", "Nonion P-208", "Nonion P-210", "Nonion P-213", "Nonion S-207", "Nonion S-215", "Nonion S-220", "Nonion K-204", "Nonion K-215", "Nonion K-220", "Nonion K-230", "Nonion T-2085", "Nonion NS" series, "Nonion HS" series, "Persoft NK-60", "Persoft NK-100", "Uniox M-400", "Uniox M-550", "Uniox M-200" and "Uniox C-2300" (Trademarks), all available from Nippon Oils & Fats Co., Ltd.

The polypropylene glycol monoether is represented by the following formula:

$$R-O-(C_3H_6O)_n-H$$

wherein R represents an alkyl group having 1 to 30 carbon atoms, preferably 10 to 20 carbon atoms, a substituted or unsubstituted aryl group, or most preferably a phenyl group substituted with an alkyl group having 1 to 20 carbon atoms, and n represents the mean number of added moles of a hydroxypropylene group, which is an integer of 1 or more, preferably 5 to 100.

Examples of commercially available polypropylene glycol monoether having the above formula include the products of Sanyo Chemical Industries, Ltd. with the trademarks of "Newpol LB-65", "Newpol LB-285", "Newpol LB-385", "Newpol LB-125", "Newpol LB-1145", "Newpol LB-1715", "Newpol LB-3000", "Newpol LB-300X", "Newpol LB-400XY", "Newpol LB-650X" and "Newpol LB-1800X".

Monoethers of a copolymer of hydroxyethylene and hydroxypropylene are known compounds, and commercially available products of the monoethers having a molecular weight of 200 to 20,000, more preferably 200 to 4,000, can be employed in the present invention.

Specific examples of such monoethers include the products of Sanyo Chemical Industries, Ltd. with the trademarks of "Newpol 50HB-55", "Newpol 50HB-100", "Newpol 50HB-260", "Newpol 50HB-400", "Newpol 50HB-660", "Newpol 50HB-2000" and "Newpol 50HB-5100".

When the above-described polyalkylene glycol, polyalkylene glycol ester or polyalkylene glycol ether is incorporated into the overcoat layer, it is used in an amount of 0.01 to 10 parts by weight, preferably 0.1 to 1 parts by weight, per 1 part by weight of the binder resin contained in the overcoat layer. When one of these compound is incorporated into the intermediate layer, it is used in an amount of 0.1 to 50 parts by weight, preferably 0.2 to 20 parts by weight, per 100 parts by weight of the binder resin contained in the intermediate layer.

The overcoat layer and the photoconductive layer are formed in the same manner. The preferred thickness of the overcoat layer is 1 to 30 μm. Furthermore, it is preferable to incorporate finely-divided particles of a metallic oxide such as $SnO_2$, $Sb_2O_3$, $In_2O_3$ and $TiO_2$ into the overcoat layer in order to prevent the rise of the residual electric potential. The amount of the metallic oxide is 10 to 80 wt.% of the entire weight of the overcoat layer. The particle size of the metallic oxide is 0.5 μm or less, preferably 0.3 μm or less.

In the case where the overcoat layer is composed of the intermediate layer and the protective layer, the intermediate layer has a thickness of 10 μm or less, preferably 1 μm or less, and the protective layer has a thickness ranging from 1 to 30 μm.

Into this protective layer, it is preferable to incorporate finely-divided particles of a metallic oxide which are the same as those employed in the overcoat layer.

For the binders in the overcoat layer and the intermediate layer, the following thermoplastic and thermosetting resins can be employed; for example, polystyrene, a copolymer of styrene and acrylonitrile, a copolymer of styrene and butadiene, a copolymer of styrene and maleic anhydride, polyester, polyvinyl chloride, a copolymer of vinyl chloride and vinyl acetate, polyvinyl acetate, polyethylene, polypropylene, polyvinylidene chloride, fluorine-contained resin, polyacrylate resin, phenoxy resin, polycarbonate, polyamide, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin, alkyd resin and cellulose.

The present invention will now be explained in more detail.

In the present invention, the conductive substrate is employed so as to attract electric charges of a reverse polarity from the charges generated by electrification. The materials which can be employed as the substrate are those having an electric resistance of $10^8$ Ω or less, and capable of withstanding the conditions for forming the intermediate, charge generation and charge transport layers.

Examples of such materials include electroconductive metals such as Al, Ni, Cr, Zn and stainless steel, and inorganic insulation materials, such as glass and ceramics, and organic insulation materials, such as polyester, polyimide, phenol resin, nylon resin and paper. In the case of the insulating materials, their surfaces are coated with an electroconductive material, such as Al, Ni, Cr, Zn, stainless steel, carbon, $SnO_2$ and $In_2O_3$, by means of vacuum deposition, sputtering or spray coating.

Either a mono-layered or a multi-layered (laminated type) photoconductive layer can be employed in the present invention.

The mono-layered photoconductive layer can serve as both a charge generation layer and a charge transport layer. When such a layer is exposed to light, latent electrostatic images are formed thereon.

In order to form the photoconductive layer of the mono-layered type, photoconductive powder such as zinc oxide, titanium oxide or sensitized zinc oxide, amorphous silicone powder, crystalline selenium powder, a phthalocyanine pigment, or an azo pigment is coated onto the electroconductive substrate together with a binder resin and, if necessary, charge transporting materials which will be described later. Binder resins which are employed in the multi-layered photoconductor can be employed in the above layer. Such binder resins will be described later.

Furthermore, a mono-layered photoconductive layer which is made of the charge transporting material and a eutectic crystalline complex prepared by a pyrylium dye and a bisphenol A type polycarbonate can also be employed in the present invention.

It is preferable that the mono-layered photoconductive layer have a thickness ranging from 5 to 30 μm.

The laminated type photoconductive layer consists of a charge generation layer and a charge transport layer. The charge transport layer transports the charges which are generated in and liberated from the charge generation layer under the application of light. It also dissipates the charges which are induced in the electroconductive layer. The charge transport layer is required to have high electric resistance so that the electric charges can be maintained. It is also required to have low dielectric constant and high charge transportation ability so that high surface potential can be obtained by the electric charges maintained. In order to meet the above requirements, an organic charge transport layer containing as an effective component an organic charge transporting material is employed.

Generally known compounds can be employed as the organic charge transporting material, such as poly-N-vinyl carbazole compounds, pyrazoline compounds, α-phenylstilbene compounds, hydrazone compounds, diarylmethane compounds, triphenyl amine compounds, divinyl benzene compounds, fluorene compounds, anthracene compounds, oxadiazole compounds, and diamino carbazole compounds.

When the above organic charge transporting materials other than the polymers such as polyvinyl carbazole compounds are employed, they are, in advance, incorporated into a polymer or copolymer resin such as polyamide resin, polyurethane resin, polyester resin, epoxy resin, poly-carbonate resin, polyether resin (all polycondensed type), polystyrene resin, polyacrylate resin, polymethacrylate resin, poly-N-vinyl carbazole resin, polyvinyl butyral resin, a styrene—butadiene copolymer resin, and a styrene-acrylonitrile copolymer resin.

A plasticizer may be incorporated into the above mixture of the organic charge transporting material and the resin, if necessary. Examples of the plasticizer include halogenated paraffin, dimethyl naphtharene, dibutyl phthalate, dioctylphthalate, tricresil phosphate, and polymers and copolymers such as polyester.

The charge transporting material, the binder resin and silicone oil which serves as a labelling agent are dissolved in a proper organic solvent. The resulting solution is coated onto the electroconductive substrate by means of roller coating, dip coating, spray coating or blade coating, and dried at a temperature between 50 and 200° C. Thus, an electric charge transport layer having a thickness between 5 and 100 μm can be obtained.

The weight ratio of the charge transporting material to the binder resin is 2:8 to 8:2; and the incorporated amount of the silicone oil is 0.001 to 1 parts by weight per 100 parts by weight of the binder resin.

The charge generation layer generates electric charges when the layer is exposed to light, and liberates them from the layer. In the present invention, the charge generation layer contains as a charge generating material an organic dye, an organic pigment, crystalline selenium, or arsenic selenide.

Examples of the organic dye and pigment include phthalocyanine pigments, disazo pigments, trisazo pigments, perylene pigments, squalic salt dyes, azulenium salt dyes, and quinone condensed multi-ring compounds.

Specific examples of the disazo pigment and the trisazo pigments are as follows.

| Pigment No. | A |
|---|---|
| 1 | 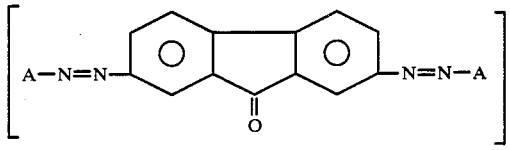 |
| | 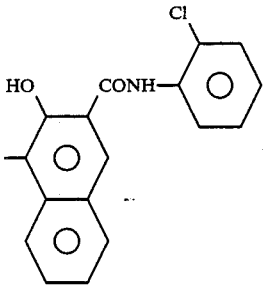 |

-continued
| Pigment No. | A |
|---|---|
| 2 | 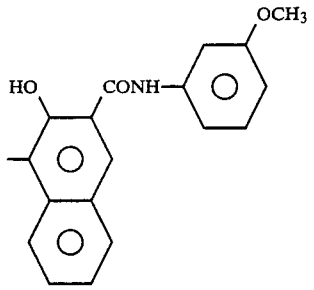 |
| 3 | 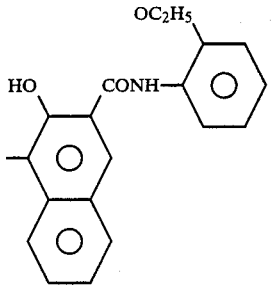 |
| 4 | 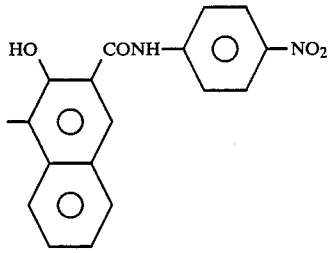 |
| 5 | 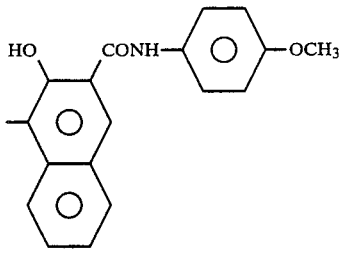 |
| 6 | 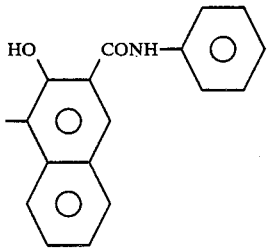 |

-continued
| Pigment No. | A |
|---|---|
| 7 | 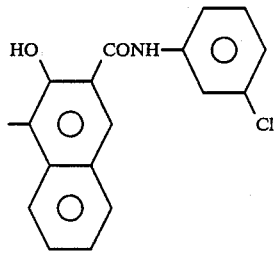 |
| 8 | 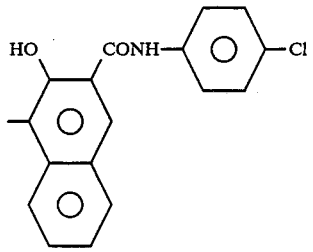 |
| 9 | 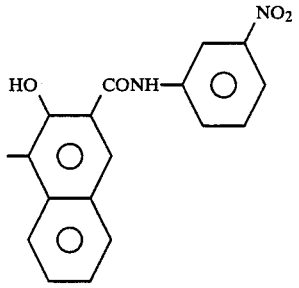 |
| 10 | 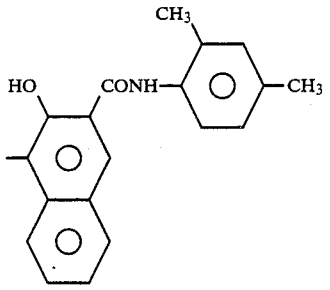 |
| 11 | 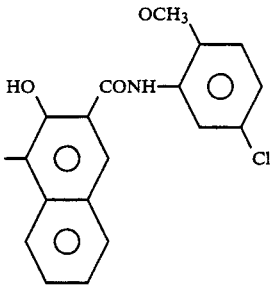 |

-continued
| Pigment No. | A |
|---|---|
| 12 | 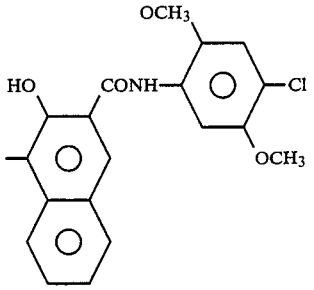 |
| 13 | 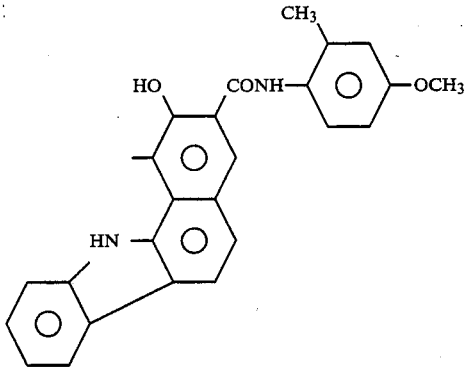 |
| 14 | 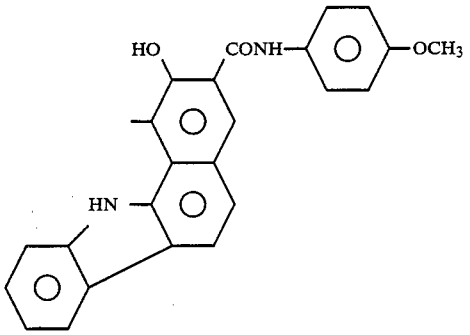 |
| 15 | 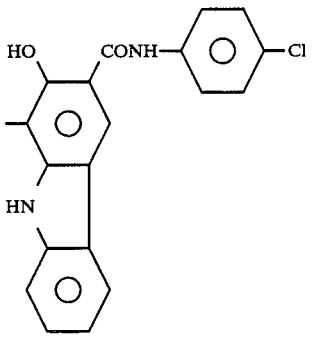 |

-continued
| Pigment No. | A |
|---|---|
| 16 | 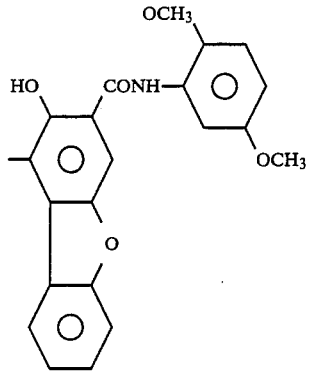 |
| 17 | 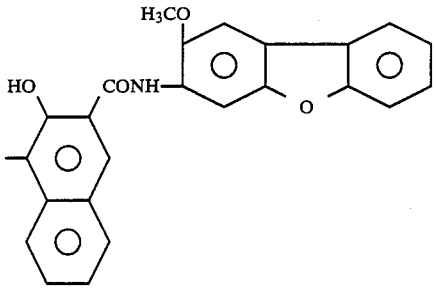 |
| 18 | 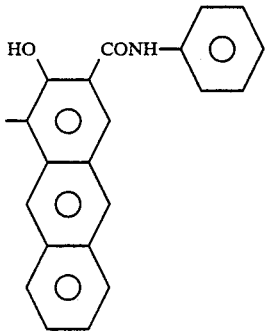 |
| 19 | 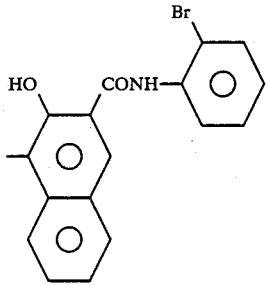 |
| 20 | 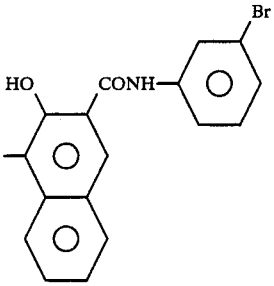 |

-continued
| Pigment No. | A |
|---|---|
| 21 | 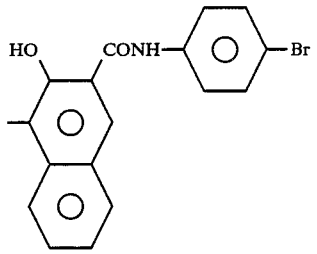 |
| | 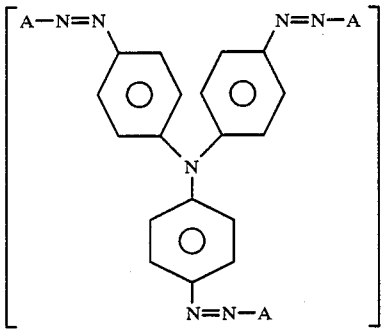 |
| 22 | 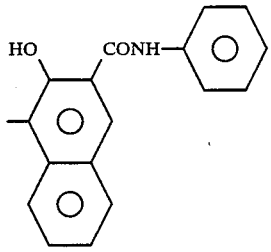 |
| 23 | 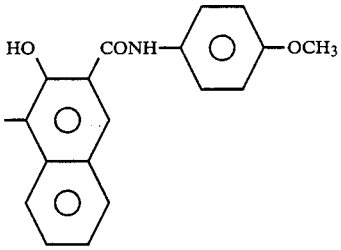 |
| 24 | 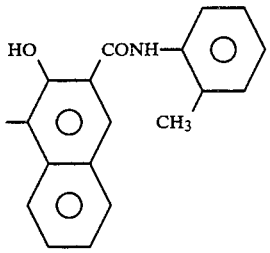 |

-continued
| Pigment No. | A |
|---|---|
| 25 | 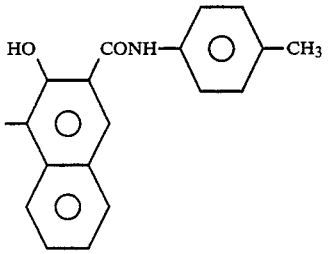 |
| 26 | 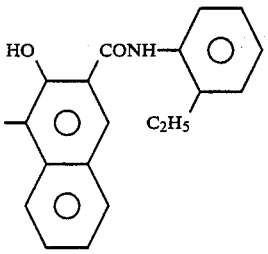 |
| 27 | 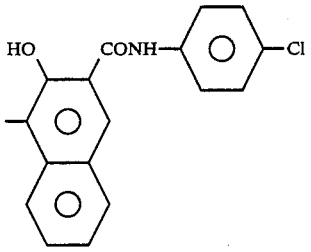 |
| 28 | 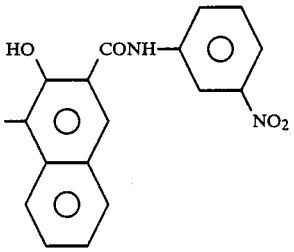 |
| 29 | 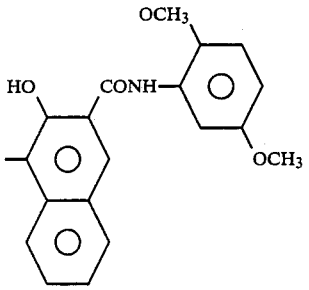 |

-continued
| Pigment No. | A |
|---|---|
| 30 | 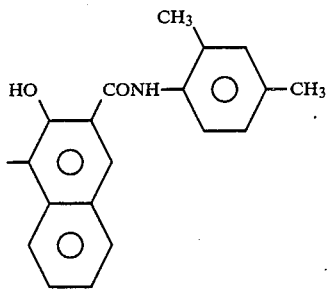 |
| 31 | 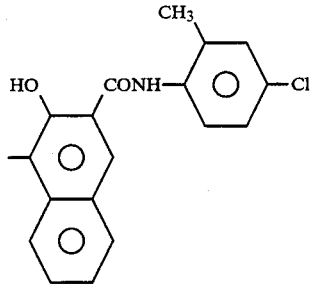 |
| 32 | 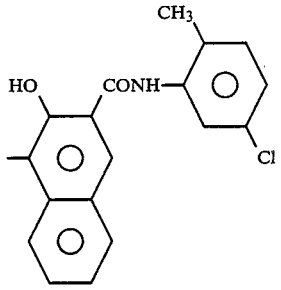 |
| 33 | 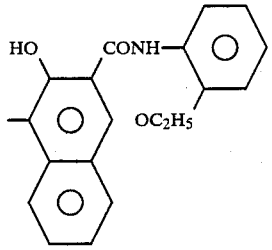 |
| 34 | 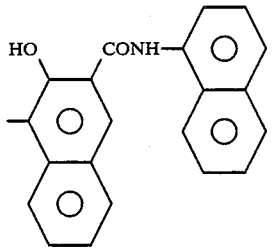 |

-continued
| Pigment No. | A |
|---|---|
| 35 | 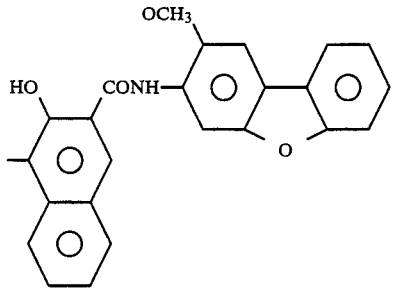 |
| 36 | 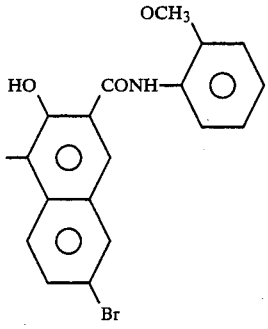 |
| 37 | 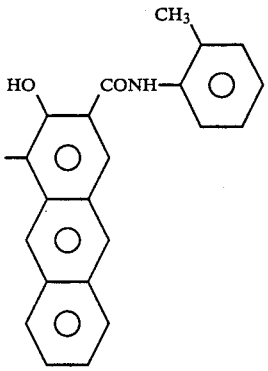 |
| 38 | 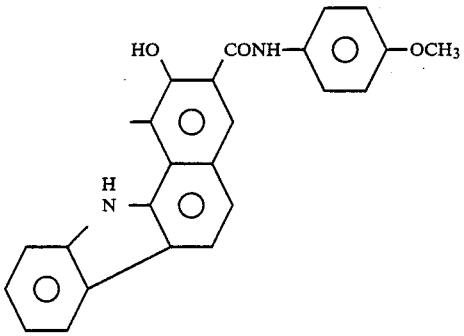 |

-continued
| Pigment No. | A |
|---|---|
| 39 | 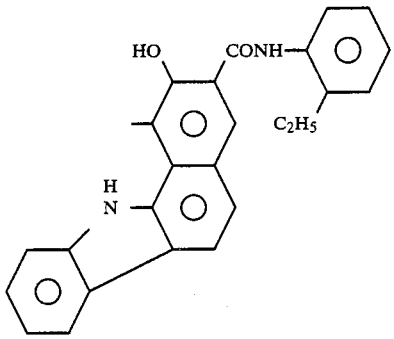 |
| 40 | 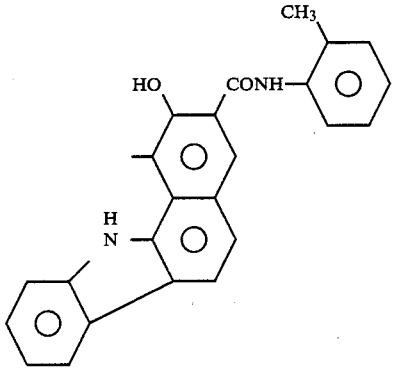 |
| 41 | 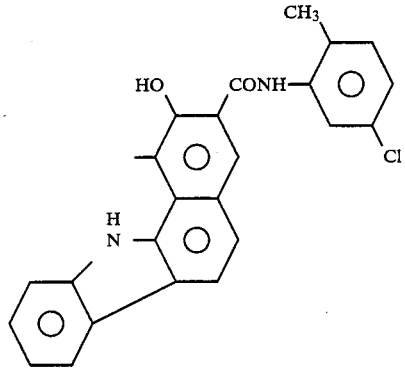 |
| 42 | 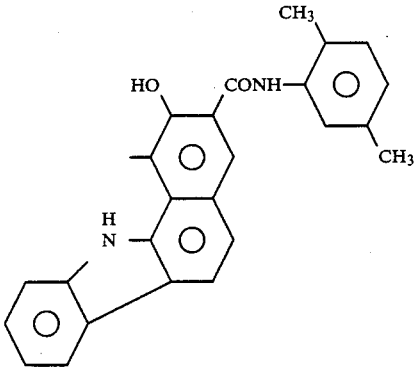 |

-continued
| Pigment No. | A |
|---|---|
| 43 | 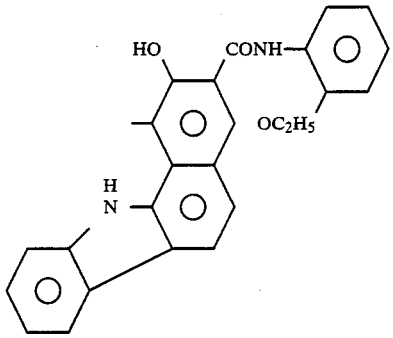 |
| 44 | 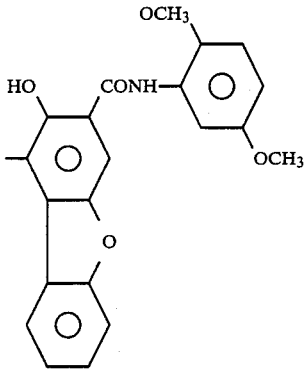 |
| 45 | 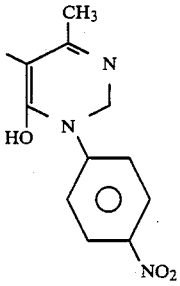 |
| 46 | 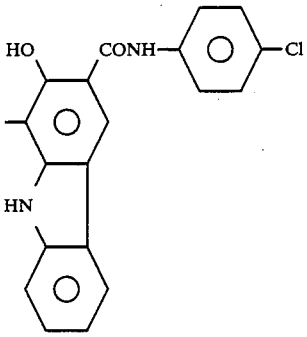 |

-continued
| Pigment No. | A |
|---|---|
| 47 | 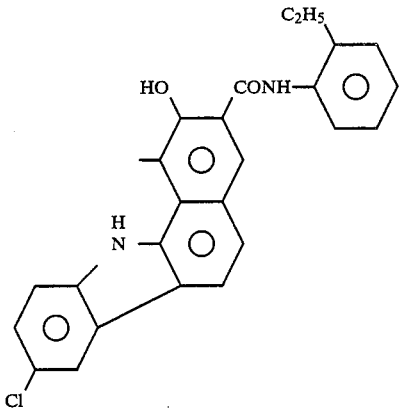 |
| 48 | 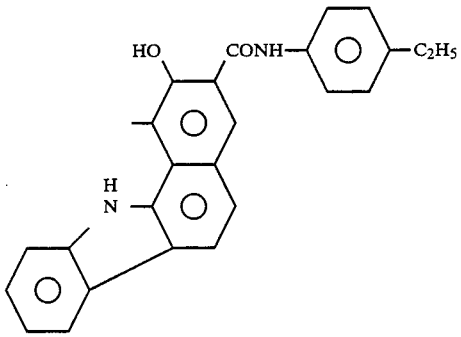 |
| | 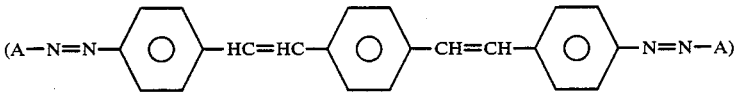 |
| 49 | 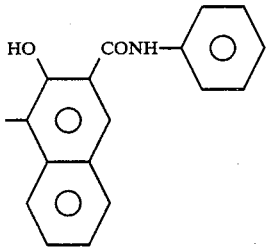 |
| 50 | 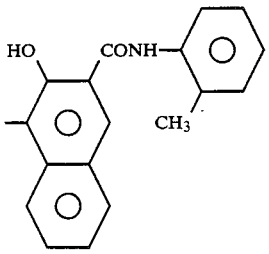 |

-continued
| Pigment No. | A |
|---|---|
| 51 | 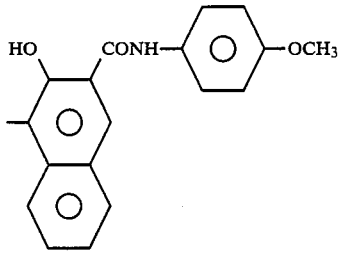 |
| 52 | 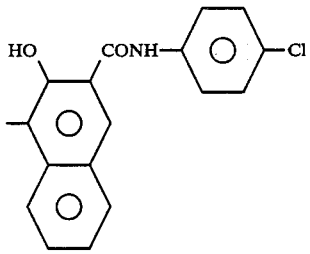 |
| 53 | 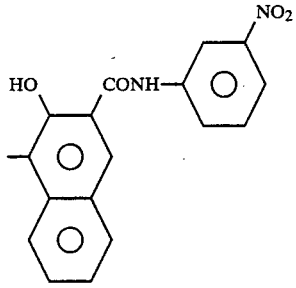 |
| 54 | 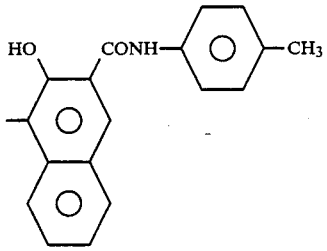 |
| 55 | 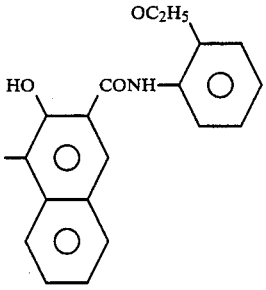 |

-continued
| Pigment No. | A |
|---|---|
| 56 | 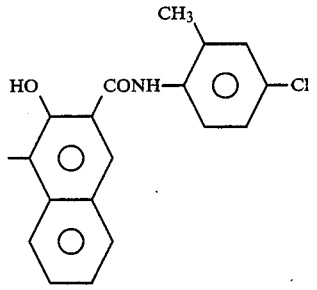 |
| 57 | 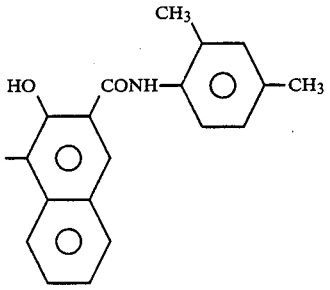 |
| 58 | 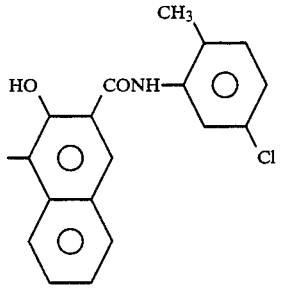 |
| 59 | 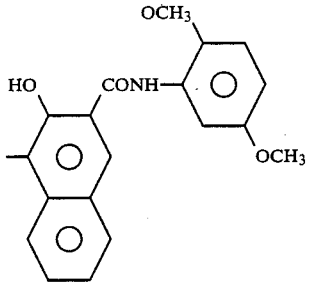 |
| 60 | 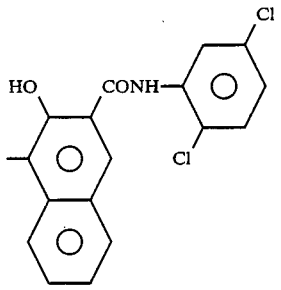 |

-continued
| Pigment No. | A |
|---|---|
| 61 | 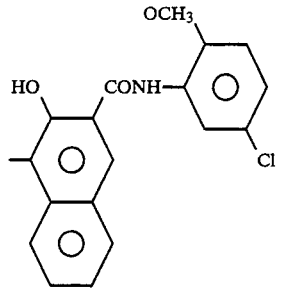 |
| 62 | 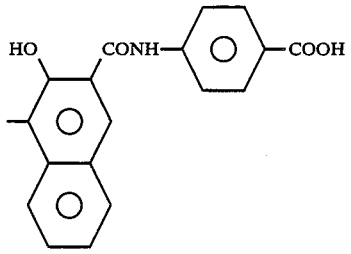 |
| 63 | 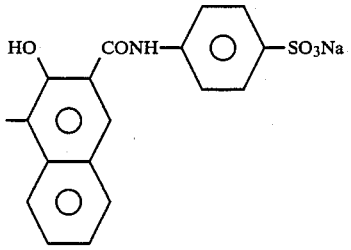 |
| 64 | 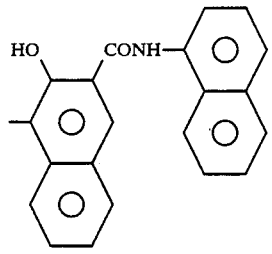 |
| 65 | 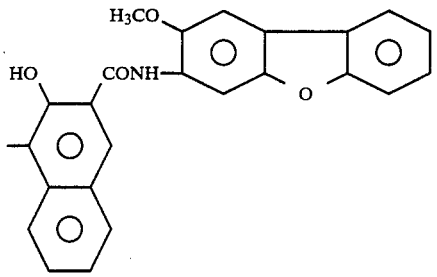 |

-continued
| Pigment No. | A |
|---|---|
| 66 | 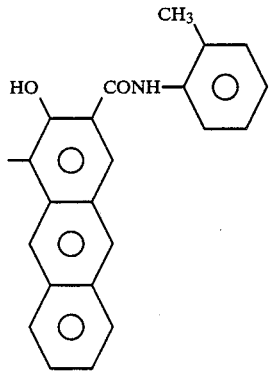 |
| 67 | 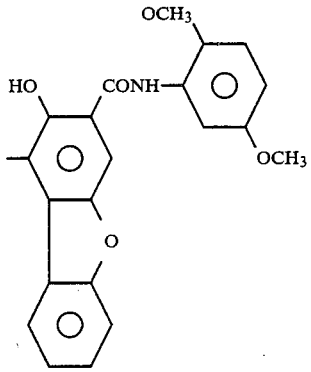 |
| 68 | 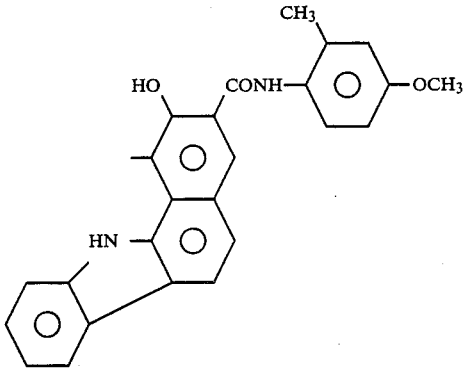 |
| 69 | 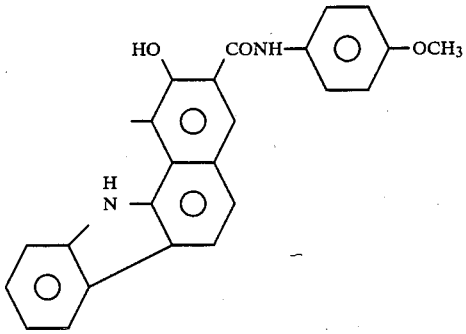 |

-continued

| Pigment No. | A |
|---|---|
| 70 | 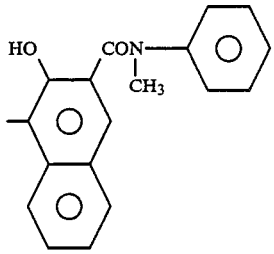 |
| 71 | 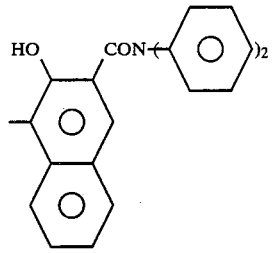 |
| 72 | 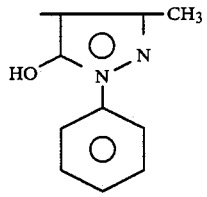 |
| 73 | 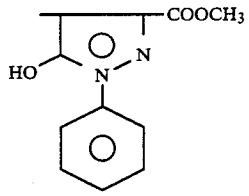 |
| 74 | 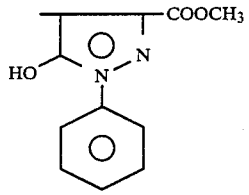 |

These organic dyes and pigments are dispersed in an organic solvent with or without a resin in a ball mill, a sand mill, a kneader having three rollers, an attriter, or a dispersing apparatus using ultrasonic wave.

As the binder resin which is used together with the above organic dyes or pigments, the same resins as used in the charge transport layer can be employed.

The charge generation layer can be formed in the same manner as in the formation of the charge transport layer. The preferred thickness of the charge generation layer is in the range of 0.05 to 10 μm.

In the case where crystalline selenium or arsenic selenide powder is used as the charge generating material in the charge generation layer, a charge transporting binder agent and/or a charge transporting organic compound is co-employed.

Examples of such charge transporting materials include polyvinyl carbazole and its derivatives such as those having a substituent of a halogen such as chlorine or bromine, a methyl group or an amino group in its carbazole structure, polyvinyl pyrene, oxadiazole, pyrazoline, hydrazone, diarylmethane, α-phenylstilbene, diaryl methane compounds, and nitrogen-containing compounds such as triphenyl amine. Of these compounds, polyvinyl carbazole and derivatives thereof are preferably employed in the present invention.

The above compounds can be employed either singly or in combination. In the case where they are employed in combination, the use of polyvinyl carbazole or derivatives thereof and other above-mentioned charge transporting compounds is preferable.

In order to improve adhesion and plasticity, binder resins which are used with the organic dyes and pigments can also be employed with the crystalline selenium or arsenic selenide powder.

The amount of the charge generating material is preferably 30 to 90 wt.% of the entire weight of the charge generation layer, and the thickness of the charge generation layer is preferably 0.2 to 5 μm.

Other features of this invention will become apparent in the course of the following description of exemplary embodiments, which are given for illustration of the invention and are not intended to be limiting thereof.

Example 1—1

Preparation of Charge Transport Layer Forming Liquid

A charge transport layer forming liquid No. 1—1 having the following formulation was prepared.

| | parts by weight |
|---|---|
| α-Phenylstilbene having the following formula (charge transporting material) | 10 |
| Polycarbonate (Trademark "Panlite C-1400" made by Teijin Limited) | 10 |
| Silicone oil (Trademark "KF50", made by Shin-Estu Silicone Co., Ltd.) | 0.0002 |
| Tetrahydrofuran | 80 |

Preparation of Charge Generation Layer Forming Liquid

The previously mentioned azo pigment No. 1 and cyclohexanone in a weight ratio of 1:16 were placed in a ball mill pot, followed by ball-milling for 48 hours by using stainless steel balls.

Thereafter, the same amount of cyclohexanone was added to the above mixture, and ball-milling was continued for a further 24 hours.

The resulting mixture taken out of the ball mill was diluted with cyclohexanone under stirring whereby a charge generation layer forming liquid No. 1—1 was obtained, which contained 1 wt.% of the solid components.

Preparation of Overcoat Layer Forming Liquid

A mixed resin consisting of 20 wt.% styrene, 30 wt.% methylmethacrylate, 25 wt.% acrylic acid and 25 wt.% N-methyrol acrylamide was dissolved in a 9:1 mixed solvent of toluene and butanol so that the resulting solution contained 40 wt.% of the mixed resin. 30 parts by weight of the solution thus prepared and 12 parts by weight of $SnO_2$ powder were dispersed in a suitable amount of a 9:1 mixed solvent of toluene and n-butanol in a ball mill for 72 hours. To the resulting dispersion, 3 parts by weight of dibenzo-18-crown-6-ether was added, and stirred, whereby an overcoat layer forming liquid No. 1—1 was obtained.

Preparation of Photoconductor

An aluminum substrate was dip-coated with the above-prepared charge transport layer forming liquid at a pulling up speed of 6 mm/sec, and dried at 120° C. for 30 minutes, thereby forming a charge transport layer 20 μm in thickness on the substrate.

Thereafter, the charge generation layer forming liquid was dip-coated onto the charge transport layer at a pulling up speed of 5 mm/sec, and dried at 120° C. for 20 minutes, thereby forming a charge generation layer on the charge transport layer.

Finally, the overcoat layer forming liquid was spray-coated onto the above charge generation layer, and heated at 130° C. for 30 minutes, thereby forming an overcoat layer 5 μm in thickness on the charge generation layer.

Thus, a photoconductor No. 1—1 according to the present invention was prepared.

COMPARATIVE EXAMPLE 1—1

Example 1—1 was repeated except that dibenzo18-crown-6-ether was eliminated from the overcoat layer forming liquid prepared in Example 1—1, whereby a comparative photoconductor No. 1—1 was prepared.

EXAMPLE 1-2

Example 1—1 was repeated except that the azo pigment No. 1 used in the charge generation layer forming liquid No. 1—1 was replaced with the azo pigment No. 47, whereby a photoconductor No. 1-2 according to the present invention was prepared.

EXAMPLE 1-3

Example 1—1 was repeated except that dibenzo-18-crown-6-ether used in the overcoat layer forming liquid No. 1—1 was replaced with 18-crown-6-ether, whereby a photoconductor No. 1-3 according to the present invention was prepared.

EXAMPLE 1-4

Example 1—1 was repeated except that an intermediate layer having a thickness of 0.1 μm was interposed between the charge generation layer and the overcoat layer, whereby a photoconductor No. 1-4 according to the present invention was prepared.

The intermediate layer was formed in the following manner. An intermediate layer forming liquid consisting of 2 parts by weight of nylon resin (Trademark "CM 8000" made by Toray Industries, Inc.), 60 parts by weight of methanol and 38 parts by weight of butanol was dip-coated onto the charge generation layer at a pulling up speed of 3 mm/sec, and dried at 120° C. for 20 minutes

EXAMPLE 1-5

Example 1—1 was repeated except that the overcoat layer forming liquid No. 1—1 was replaced with the following overcoat layer forming liquid No. 1-5, whereby a photoconductor No. 1-5 according to the present invention was prepared.

Preparation of Overcoat Layer Forming Liquid

The following components were well dispersed in a ball mill for 72 hours, and the resulting dispersion was diluted with cyclohexanone to obtain a dispersion containing 10 wt.% of the solid components.

To the above dispersion, 5 parts by weight of dibenzo18-crown-6-ether was added, and stirred, thereby obtaining an overcoat layer forming liquid No. 1-5.

| | parts by weight |
|---|---|
| 20% Cyclohexanone solution of phenoxy resin "PKHJ" (Trademark) made by Union Carbide Corp. | 25 |
| Tin oxide powder | 5 |
| Cyclohexanone | 70 |

COMPARATIVE EXAMPLE 1-2

Example 1-4 was repeated except that dibenzo-18-crown-6-ether was eliminated from the overcoat layer forming liquid prepared in Example 1-4, whereby a comparative photoconductor No. 1-2 was prepared.

Each of the above electrophotographic photoconductors was positively charged in the dark under application of +6 kV of corona charge for 20 seconds. The surface potential of the photoconductor $V_2$, 2 seconds after the initiation of the charging, was measured by the paper analyzer. The photoconductor was then allowed to stand in the dark without applying any charge thereto until its surface potential reached +800 V. The photoconductor was then illuminated by a tungsten lamp in such a manner that the illuminance on the illuminated surface of the photoconductor was 4.5 lux so that the exposure S (lux·sec) required to reduce the surface potential (+800 V) to +400 V was measured.

The photoconductor was then exposed to a tungsten light having a color temperature of 2856° K with an exposure of 100,000 lux·sec, and the surface potential $V_2'$ and the exposure S' were measured again in the same manner as mentioned above.

The results are shown in Table 1—1.

TABLE 1-1

| Photo-conductor | Before Fatigue | | After Fatigue | |
|---|---|---|---|---|
| | $V_2$ (V) | S (lux · sec) | $V_2'$ (V) | S' (lux · sec) |
| No. 1-1 | 880 | 0.56 | 862 | 0.48 |
| No. 1-2 | 850 | 0.40 | 810 | 0.39 |
| No. 1-3 | 873 | 0.54 | 855 | 0.55 |
| No. 1-4 | 821 | 0.53 | 805 | 0.50 |
| No. 1-5 | 830 | 0.55 | 815 | 0.53 |
| Comp. No. 1-1 | 872 | 0.55 | 615 | 0.50 |
| Comp. No. 1-2 | 779 | 0.49 | 393 | 0.43 |

The photoconductor was attached to the surface of an Al drum having a thickness of 3 mm and a size of 80ϕ×340 mm. This was placed in a copying machine (Trademark "FT 4060" made by Ricoh Company Ltd.), and images were repeatedly printed. The images were usually observed at the outset of printing and after 10,000 prints had been made. The results are shown in Table 1-2.

TABLE 1-2

| Photo-conductor | Printed Images at Outset of Printing | Printed Images after 10,000-time Printing |
|---|---|---|
| No. 1-1 | clear | clear |

TABLE 1-2-continued

| Photo-conductor | Printed Images at Outset of Printing | Printed Images after 10,000-time Printing |
|---|---|---|
| No. 1-2 | clear | clear |
| No. 1-3 | clear | clear |
| No. 1-4 | clear | clear |
| No. 1-5 | clear | clear |
| Comp. No. 1-1 | clear | Image density was found low |
| Comp. No. 1-2 | clear | Image density was found low |

The results of the above tests demonstrate that the electrophotographic photoconductors according to the present invention, which comprise an overcoat layer containing the crown ether, have high sensitivity, and show extremely small reduction in the chargeability caused by pre-exposure fatigue. Furthermore, the photoconductors of the present invention bring about no delay in the rise of the charged potential and a minimized change in the residual electric potential even after repeated charging and exposing.

EXAMPLE 2-1

Preparation of Charge Transport Layer Forming Liquid

A charge transport layer forming liquid No. 2-1 having the following formulation was prepared.

| | parts by weight |
|---|---|
| α-Phenylstilbene having the following formula (charge transporting material) | 10 |

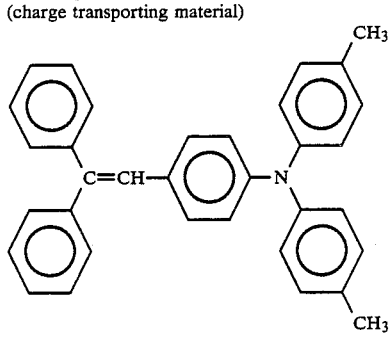

| | |
|---|---|
| Polycarbonate Trademark "Panlite C-1400" made by Teijin Limited) | 10 |
| Silicone oil (Trademark "KF50", made by Shin-Estu Silicone Co., Ltd.) | 0.0002 |
| Tetrahydrofuran | 80 |

Preparation of Charge Generation Layer Forming Liquid

The azo pigment No. 1 and cyclohexanone in a weight ration of 1:16 were placed in a ball mill pot, followed by ball-milling for 48 hours by using stainless steel balls.

Thereafter, the same amount of cyclohexanone was added to the above mixture, and ball-milling was continued for a further 24 hours.

The resulting mixture taken out of the ball mill was diluted with cyclohexanone under stirring, whereby a charge generation layer forming liquid No. 2-1 was obtained, which contained 1 wt.% of the solid components.

Preparation of Overcoat Layer Forming Liquid

A mixed resin consisting of 20 wt.% styrene, 30 wt.% methylmethacrylate, 25 wt.% acrylic acid and 25 wt.% N-methyrol acrylamide was dissolved in a 9:1 mixed solvent of toluene and butanol so that the resulting solution contained 40 wt.% of the mixed resin. 30 parts by weight of the solution thus prepared and 12 parts by weight of $SnO_2$ powder were dispersed in a suitable amount of a 9:1 mixed solvent of toluene and n-butanol in a ball mill for 72 hours. To the resulting dispersion, 3 parts by weight of polyethylene glycol (Trademark "PEG6000S" made by Sanyo Chemical Industries, Ltd.) was added, and stirred, whereby an overcoat layer forming liquid No. 2-1 was obtained.

Preparation of Photoconductor

An aluminum substrate was dip-coated with the above-prepared charge transport layer forming liquid at a pulling up speed of 6 mm/sec, and dried at 120° C. for 30 minutes, thereby forming a charge transport layer 20 μm in thickness on the substrate.

Thereafter, the charge generation layer forming liquid was dip-coated onto the charge transport layer at a pulling up speed of 5 mm/sec, and dried at 120° C. for 20 minutes, thereby forming a charge generation layer on the charge transport layer.

Finally, the overcoat layer forming liquid was spray-coated onto the above charge generation layer, and heated at 130° C. for 30 minutes, thereby forming a protective layer 5 μm in thickness on the charge generation layer.

Thus, a photoconductor No. 2-1 according to the present invention was prepared.

EXAMPLE 2—2

Example 2-1 was repeated except that polyethylene glycol used in the overcoat layer forming liquid No. 2-1 was replaced with polyethylene glycol monocarboxylic acid ester (Trademark "Ionet MS400" made by Sanyo Chemical Industries, Ltd.), whereby a photoconductor No. 2—2 according to the present invention was prepared.

EXAMPLE 2-3

Example 2-1 was repeated except that polyethylene glycol used in the overcoat layer forming liquid No. 2-1 was replaced with polyethylene glycol monoether (Trademark "Emulmin L380" made by Sanyo Chemical Industries, Ltd.), whereby a photoconductor No. 2-3 according to the present invention was prepared.

COMPARATIVE EXAMPLE 2-1

Example 2-1 was repeated except that polyethylene glycol was eliminated from the overcoat layer forming liquid No. 2-1, whereby a comparative photoconductor No. 2-1 was prepared.

EXAMPLE 2-4

Example 2-1 was repeated except that the pigment No.1 used in the charge generation layer forming liquid No. 2-1 was replaced with the pigment No. 47, whereby a photoconductor No. 2-4 according to the present invention was prepared.

EXAMPLE 2-5

Example 2—2 was repeated except that the pigment No.1 used in the charge generation layer forming liquid employed in Example 2—2 was replaced with the pigment No. 47, whereby a photoconductor No. 2-5 according to the present invention was prepared.

EXAMPLE 2-6

Example 2-3 was repeated except that the pigment No.1 used in the charge generation layer forming liquid employed in Example 2-3 was replaced with the pigment No. 47, whereby a photoconductor No. 2-6 according to the present invention was prepared.

EXAMPLE -7

Example 2-1 was repeated except that polyethylene glycol used in the overcoat layer forming liquid No. 2-1 was replaced with polypropylene glycol (made by Wako Pure Chemical Industries, Ltd.), whereby a photoconductor No. 2-7 according to the present invention was prepared.

EXAMPLE 2-8

Example 2—2 was repeated except that polyethylene glycol monocarboxylic acid ester used in the overcoat layer forming liquid prepared in Example 2—2 was replaced with polyethylene glycol dicarboxylic acid ester (Trademark "Ionent DL200" made by Sanyo Chemical Industries, Ltd.), whereby a photoconductor No. 2-8 according to the present invention was prepared.

EXAMPLE 2-9

Example 2-3 was repeated except that polyethylene glycol monoether used in the overcoat layer forming liquid prepared in Example 2-3 was replaced with polypropylene glycol monoether (Trademark "Newpol LB1800X" made by Sanyo Chemical Industries, Ltd.), whereby a photoconductor No. 2-9 according to the present invention was prepared.

EXAMPLE 2-10

Example 2-1 was repeated except that an intermediate layer having a thickness of 0.1 μm was interposed between the charge generation layer and the overcoat layer, whereby a photoconductor No. 2-10 according to the present invention was prepared.

The intermediate layer was formed in the following manner. An intermediate layer forming liquid was prepared by dispersing 2 parts by weight of nylon resin (Trademark "CM8000" made by Toray Industries, Inc.) in 60 parts by weight of methanol and 38 parts by weight of butanol. The resulting liquid was dip-coated onto the charge generation layer at a pulling up speed of 3 mm/sec, and then dried at 120° C. for 20 minutes, thereby forming an intermediate layer on the charge generation layer.

EXAMPLE 2-11

Example 2—2 was repeated except that an intermediate layer having a thickness of 0.1 μm was interposed between the charge generation layer and the overcoat layer in the same manner as in Example 2-10, whereby a photoconductor No. 2-11 according to the present invention was prepared.

EXAMPLE 2-12

Example 2-3 was repeated except that an intermediate layer having a thickness of 0.1 μm was interposed between the charge generation layer and the overcoat layer in the same manner as in Example 2-10, whereby a photoconductor No. 2-12 according to the present invention was prepared.

2-13

Example 2-1 was repeated except that the overcoat layer forming liquid No. 2-1 was replaced with an overcoat layer forming liquid prepared in the following manner, whereby a photoconductor No. 2-13 according to the present invention was prepared.

Preparation of Overcoat Layer Forming Liquid

The following components were dispersed in a ball mill for 72 hours, and the resulting dispersion was diluted with cyclohexanone, thereby obtaining a dispersion containing 10 wt.% of the solid components.

To this dispersion, 5 parts by weight of polybutylene glycol (Trademark "Terathane 2900" made by Du Pont Japan Ltd.) was added under stirring, whereby an overcoat layer forming liquid was prepared.

EXAMPLE 2-14

Example 2-13 was repeated except that polybutylene glycol used in the overcoat layer forming liquid prepared in Example 2-13 was replaced with polyoxyethylene sorbitan monolaurate (Trademark "Ionent T-20C" made by Sanyo Chemical Industries, Ltd.), whereby a photoconductor No. 2-14 according to the present invention was prepared.

EXAMPLE 2-15

Example 2-13 was repeated except that polybutylene glycol used in the overcoat layer forming liquid prepared in Example 2-13 was replaced with polyoxyethylene glycol monoether (Trademark "Emulmin L380" made by Sanyo Chemical Industries, Ltd.), whereby a photoconductor No. 2-15 according to the present invention was prepared.

COMPARATIVE EXAMPLE 2—2

Example 2-10 was repeated except that polyethylene qlycol was eliminated from the overcoat layer forming liquid prepared in Example 2-10, whereby a comparative photoconductor No. 2—2 was prepared.

The electrophotographic properties of the above-prepared electrophotographic photoconductors Nos. 2-1 through 2-15 according to the present invention and the comparative ones Nos. 2-1 and 2—2 were each evaluated using an electrostatic paper analyzer (Trademark "SP-428", made by Kawaguchi Electro Works) in the following manner.

Each of the above electrophotographic photoconductors was positively charged in the dark under application of +6 kV of corona charge for 20 seconds. The surface potential of the photoconductor $V_2$, 2 seconds after the initiation of the charging, was measured by the paper analyzer. The photoconductor was then allowed to stand in the dark without applying any charge thereto until its surface potential reached +800 V. The photoconductor was then illuminated by a tungsten lamp in such a manner that the illuminance on the illuminated surface of the photoconductor was 4.5 lux, so that the exposure S (lux·sec) required to reduce the surface potential (+800 V) to +400 V was measured.

The photoconductor was then exposed to a tungsten light having a color temperature of 2856° K with an exposure of 100,000 lux·sec, and the surface potential $V_2'$ and the exposure S' were measured again in the same manner as mentioned above.

The results are shown in Table 2-1.

TABLE 2-1

| Photo-conductor | Before Fatigue | | After Fatigue | |
|---|---|---|---|---|
| | $V_2$ (V) | S (lux · sec) | $V_2'$ (V) | S' (lux · sec) |
| No. 2-1 | 875 | 0.53 | 860 | 0.48 |
| No. 2-2 | 857 | 0.42 | 814 | 0.40 |
| No. 2-3 | 865 | 0.53 | 840 | 0.52 |
| No. 2-4 | 835 | 0.53 | 811 | 0.50 |
| No. 2-5 | 810 | 0.55 | 808 | 0.53 |
| No. 2-6 | 870 | 0.54 | 852 | 0.48 |
| No. 2-7 | 850 | 0.40 | 810 | 0.39 |
| No. 2-8 | 862 | 0.54 | 853 | 0.55 |
| No. 2-9 | 820 | 0.52 | 804 | 0.49 |
| No. 2-10 | 830 | 0.55 | 815 | 0.53 |
| No. 2-11 | 880 | 0.56 | 857 | 0.49 |
| No. 2-12 | 845 | 0.40 | 810 | 0.38 |
| No. 2-13 | 870 | 0.53 | 854 | 0.55 |
| No. 2-14 | 821 | 0.53 | 804 | 0.45 |
| No. 2-15 | 825 | 0.55 | 815 | 0.52 |
| Comp No. 2-1 | 872 | 0.55 | 615 | 0.50 |
| Comp. No. 2-2 | 779 | 0.49 | 393 | 0.43 |

The photoconductor was attached to the surface of an Al drum having a thickness of 3 mm and a size of 80ϕ×340 mm. This was placed in a copying machine (Trademark "FT 4060" made by Ricoh Company Ltd.), and images were repeatedly printed. The images were usually observed at the outset of printing and after 10,000 prints had been made. The results are shown in Table 2-2.

TABLE 2-2

| Photo-conductor | Printed Images at Outset of Printing | Printed Images after 10,000-time Printing |
|---|---|---|
| No. 2-1 | clear | clear |
| No. 2-2 | clear | clear |
| No. 2-3 | clear | clear |
| No. 2-4 | clear | clear |
| No. 2-5 | clear | clear |
| No. 2-6 | clear | clear |
| No. 2-7 | clear | clear |
| No. 2-8 | clear | clear |
| No. 2-9 | clear | clear |
| No. 2-10 | clear | clear |
| No. 2-11 | clear | clear |
| No. 2-12 | clear | clear |
| No. 2-13 | clear | clear |
| No. 2-14 | clear | clear |
| No. 2-15 | clear | clear |
| Comp. No. 2-1 | clear | Image density was found low |
| Comp. No. 2-2 | clear | Image density was found low |

The results of the above tests demonstrate that the electrophotographic photoconductors according to the present invention, which comprise an overcoat layer containing the polyethylene glycol, have high sensitivity, and show extremely small reduction in the chargeability caused by pre-exposure fatigue. Furthermore, the photoconductors of the present invention bring about no delay in the rise of the charged potential and a minimized change in the residual electric potential even after repeated charging and exposing.

EXAMPLE 3-1

Preparation of Charge Transport Layer Forming Liquid

A charge transport layer forming liquid No. 3-1 having the following formulation was prepared.

| | parts by weight |
|---|---|
| α-Phenylstilbene having the following formula (charge transporting material) | 10 |
| Polycarbonate (Trademark "Panlite C-1400" made by Teijin Limited) | 10 |
| Silicone oil Trademark "KF50", made by Shin-Estu Silicone Co., Ltd.) | 0.0002 |
| Tetrahydrofuran | 80 |

Preparation of Charge Generation Layer Forming Liquid

The azo pigment No. 1 and cyclohexanone in a weight ratio of 1:16 were placed in a ball mill pot, followed by ball-milling for 48 hours by using stainless steel balls.

Thereafter, the same amount of cyclohexanone was added to the above mixture, and ball-milling was continued for a further 24 hours.

The resulting mixture taken out of the ball mill was diluted with cyclohexanone under stirring, whereby a charge generation layer forming liquid No. 3-1 was obtained, which contained 1 wt.% of the solid components.

Preparation of Intermediate Layer Forming Liquid

An intermediate layer forming liquid No. 3-1 having the following formulation was prepared.

| | parts by weight |
|---|---|
| Dicyclohexano-18-crown-6-ether | 0.01 |
| Zirconium acetylacetone | 1 |
| γ-methacryloxypropyltrimethoxy silane | 1 |
| n-Butanol | 40 |

Preparation of Protective Layer Forming Liquid

The following components were placed in a ball mill pot, fallowed by ball-milling for 48 hours, whereby a protective layer forming liquid No. 3-1 was prepared.

| | parts by weight |
|---|---|
| Polyester resin (Trademark "V-200" made by Toyobo Co., Ltd.) | 10 |
| Tin oxide powder containing 10 wt. % of antimony oxide (made by Mitsubishi Metal Corporation) | 10 |
| Dichloroethane | 90 |

Preparation of Photoconductor

An aluminum substrate was dip-coated with the above-prepared charge transport layer forming liquid at a pulling up speed of 6 mm/sec, and dried at 120° C. for 30 minutes, thereby forming a charge transport layer 2 μm in thickness on the substrate.

Thereafter, the charge generation layer forming liquid was dip-coated onto the charge transport layer at a pulling up speed of 5 mm/sec, and dried at 120° C. for 20 minutes, thereby forming a charge generation layer on the charge transport layer.

The intermediate layer forming liquid was dip-coated onto the above-formed charge generation layer at a pulling up speed of 9 mm/sec, and dried at 80° C. for 120 minutes, whereby an intermediate layer having a thickness of 2000 Å was formed on the charge generation layer.

Finally, the protective layer forming liquid was spray-coated onto the above intermediate layer, and heated at 130° C. for 30 minutes, thereby forming a protective layer 5 μm in thickness on the intermediate layer.

Thus, a photoconductor No. 3-1 according to the present invention was prepared.

COMPARATIVE EXAMPLE 3-1

Example 3-1 was repeated except that dicyclohexano18-crown-6-ether was eliminated from the intermediate forming liquid No. 3-1, whereby a comparative photoconductor No. 3-1 was prepared.

EXAMPLE 3-2

Example 3-1 was repeated except that the pigment No. 1 used in the charge generation layer forming liquid No. 3-1 was replaced with the pigment No. 47, whereby a photoconductor No. 3-2 according to the present invention was prepared.

COMPARATIVE EXAMPLE 3-2

Example 3-2 was repeated except that dicyclohexano-18-crown-6-ether was eliminated from the intermediate layer forming liquid No. 3-1, whereby a comparative photoconductor No. 3-2 was prepared.

EXAMPLE 3—3

Example 3-1 was repeated except that dicyclohexano-18-crown-6-ether used in the intermediate layer forming liquid No. 3-1 was replaced with polydibenzo-18-crown ether, whereby a photoconductor No. 3—3 according to the present invention was prepared.

EXAMPLE 3-4

Example 3-1 was repeated except that the protective layer forming liquid No. 3-1 was replaced with a protective layer forming liquid prepared in the following manner, whereby a photoconductor No. 3–4 according to the present invention was prepared.

Preparation of Protective Layer Forming Liquid

The following components were dispersed in a ball mill for 72 hours, and the resulting dispersion was diluted with cyclohexanone, thereby obtaining a protective layer forming liquid containing 10 wt.% of the solid components.

| | parts by weight |
|---|---|
| 20% Cyclohexanone solution of phenoxy resin "PKHJ" (Trademark) made by Union Carbide Corp. | 25 |
| Tin oxide powder | 5 |
| Cyclohexanone | 70 |

COMPARATIVE EXAMPLE 3—3

Example 3–4 was repeated except that dicyclohexano-18-crown-6-ether was eliminated from the intermediate layer forming liquid used in Example 3–4, whereby a comparative photoconductor No. 3—3 was prepared.

EXAMPLE 3–5

Example 3–4 was repeated except that the intermediate layer forming liquid used in Example 3–4 was replaced with an intermediate layer forming liquid having the following formulation, whereby a photoconductor No. 3–5 according to the present invention was prepared.

Formulation of Intermediate Layer Forming Liquid

| | parts by weight |
|---|---|
| Nylon resin (Trademark "CM8000" made by Toray Industries, Inc.) | 2 |
| Dicyclohexano-18-crown-6-ether | 0.02 |
| Methanol | 60 |
| Butanol | 38 |

COMPARATIVE EXAMPLE 3–4

Example 3–5 was repeated except that dicyclohexano-18-crown-6-ether was eliminated from the intermediate layer forming liquid used in Example 3–5, whereby a comparative photoconductor No. 3–4 was prepared.

The electrophotographic properties of the above-prepared electrophotographic photoconductors Nos. 3–1 through 3–5 according to the present invention and the comparative ones Nos. 3–1 and 3–4 were each evaluated using an electrostatic paper analyzer (Trademark "SP-428", made by Kawaguchi Electro Works) in the following manner.

Each of the above electrophotographic photoconductors was positively charged in the dark under application of +6 kV of corona charge for 20 seconds. The surface potential of the photoconductor $V_2$, 2 seconds after the initiation of the charging, was measured by the paper analyzer. The photoconductor was then allowed to stand in the dark without applying any charge thereto until its surface potential reached +800 V. The photoconductor was then illuminated by a tungsten lamp in such a manner that the illuminance on the illuminated surface of the photoconductor was 4.5 lux, so that the exposure S (lux·sec) required to reduce the surface potential (+800 V) to +400 V was measured.

The photoconductor was then exposed to a tungsten light having a color temperature of 1856° K with an exposure of 100,000 lux·sec, and the surface potential $V_2'$ and the exposure S' were measured again in the same manner as mentioned above. The results are shown in Table 3–1.

TABLE 3-1

| Photo-conductor | Before Fatigue | | After Fatigue | |
|---|---|---|---|---|
| | $V_2$ (V) | S (lux · sec) | $V_2'$ (V) | S' (lux · sec) |
| No. 3-1 | 761 | 0.82 | 708 | 0.83 |
| No. 3-2 | 773 | 0.76 | 720 | 0.76 |
| No. 3-3 | 670 | 0.85 | 609 | 0.82 |
| No. 3-4 | 762 | 0.80 | 719 | 0.81 |
| No. 3-5 | 782 | 0.82 | 728 | 0.81 |
| Comp. No. 3-1 | 728 | 0.81 | 385 | 0.79 |
| Comp. No. 3-2 | 740 | 0.75 | 347 | 0.73 |
| Comp No. 3-3 | 729 | 0.80 | 436 | 0.75 |
| Comp No. 3-4 | 651 | 0.89 | 358 | 0.89 |

The photoconductor was attached to the surface of an Al drum having a thickness of 3 mm and a size of 80ϕ×340 mm. This was placed in a copying machine (Trademark "FT 4060" made by Ricoh Company Ltd.), and images were repeatedly printed. The images were usually observed at the outset of printing and after 10,000 prints had been made. The results are shown in Table 3–2.

TABLE 3-2

| Photo-conductor | Printed Images at Outset of Printing | Printed Images after 10,000-time Printing |
|---|---|---|
| No. 3-1 | clear | clear |
| No. 3-2 | clear | clear |
| No. 3-3 | clear | clear |
| No. 3-4 | clear | clear |
| No. 3-5 | clear | clear |
| Comp. No. 3-1 | clear | Image density was found low |
| Comp. No. 3-2 | clear | Image density was found low |
| Comp. No. 3-3 | clear | Image density was found low |
| Comp. No. 3-4 | clear | Image density was found low |

The results of the above tests demonstrate that the electrophotographic photoconductors according to the present invention, which comprise an intermediate layer containing the crown ether, have high sensitivity, and show extremely small reduction in the chargeability caused by pre-exposure fatigue. Furthermore, the photoconductors of the present invention bring about no delay in the rise of the charged potential and a minimized change in the residual electric potential even after repeated charging and exposing.

EXAMPLE 4–1

Preparation of Charge Transport Layer Forming Liquid

A charge transport layer forming liquid No. 4–1 having the following formulation was prepared.

| | parts by weight |
|---|---|
| α-Phenylstilbene having the following formula (charge transporting material) | 10 |

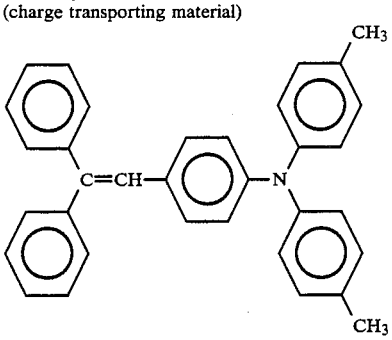

| | |
|---|---|
| Polycarbonate (Trademark "Panlite C-1400" made by Teijin Limited) | 10 |
| Silicone oil Trademark "KF50", made by Shin-Estu Silicone Co., Ltd.) | 0.0002 |
| Tetrahydrofuran | 80 |

Preparation of Charge Generation Layer Forming Liquid

The azo pigment No. 1 and cyclohexanone in a weight ratio of 1:16 were placed in a ball mill pot, followed by ball-milling for 48 hours by using stainless steel balls.

Thereafter, the same amount of cyclohexanone was added to the above mixture, and ball-milling was continued for a further 24 hours.

The resulting mixture taken out of the ball mill was diluted with cyclohexanone under stirring, whereby a charge generation layer forming liquid No. 4–1 was obtained, which contained 1 wt.% of the solid components.

Preparation of Intermediate Layer Forming Liquid

An intermediate layer forming liquid No. 4–1 having the following formulation was prepared.

| | parts by weight |
|---|---|
| Polyethylene polyoxypropylene glycol (Trademark "Newpol PE68", a block copolymer, made by Sanyo Chemical Industries, Ltd.) | 0.01 |
| Zirconium acetylacetone | 1 |
| γ-methacryloxpropyltrimethoxy silane | 1 |
| n-Butanol | 40 |

Preparation of Protective Layer Forming Liquid

The following components were placed in a ball mill pot, followed by ball-milling for 48 hours, whereby a protective layer forming liquid No. 4–1 was prepared.

| | parts by weight |
|---|---|
| Polyester resin (Trademark "V-200" made by Toyobo Co., Ltd.) | 10 |
| Tin oxide powder containing 10 wt. % of antimony oxide (made by Mitsubishi Metal Corporation) | 10 |
| Dichloroethane | 90 |

Preparation of Photoconductor

An aluminum substrate was dip-coated with the above-prepared charge transport layer forming liquid at a pulling up speed of 6 mm/sec, and dried at 120° C. for 30 minutes, thereby forming a charge transport layer on the substrate.

Thereafter, the charge generation layer forming liquid was dip-coated onto the charge transport layer at a pulling up speed of 5 mm/sec, and dried at 120° C. for 20 minutes, thereby forming a charge generation layer on the charge transport layer.

The intermediate layer forming liquid was dip-coated onto the above-formed charge generation layer at a pulling up speed of 9 mm/sec, and dried at 80° C. for 120 minutes, whereby an intermediate layer having a thickness of 2000 Å was formed on the charge generation layer.

Finally, the protective layer forming liquid was spray-coated onto the above intermediate layer, and heated at 130° C. for 30 minutes, thereby forming a protective layer 5 μm in thickness on the intermediate layer.

Thus, a photoconductor No. 4–1 according to the present invention was prepared.

EXAMPLE 4–2

Example 4–1 was repeated except that polyethylene polyoxypropylene glycol used in the intermediate layer forming liquid No. 4–1 was replaced with polyethylene glycol monocarboxylate (Trademark "Ionet MS1000" made by Sanyo Chemical Industries, Ltd.), whereby a photoconductor No. 4–2 according to the present invention was prepared.

EXAMPLE 4–3

Example 4–1 was repeated except that polyethylene polyoxypropylene glycol used in the intermediate layer forming liquid No. 4–1 was replaced with polypropylene glycol monoether (Trademark "Newpol LB65" made by Sanyo Chemical Industries, Ltd.), whereby a photoconductor No. 4–3 according to the present invention was prepared.

COMPARATIVE EXAMPLE 4–1

Example 4–1 was repeated except that polyethylene polyoxypropylene glycol was eliminated from the intermediate layer forming liquid No 4–1, whereby a comparative photoconductor No. 4–1 was prepared.

EXAMPLE 4—4

Example 4–1 was repeated except that the pigment No. 1 used in the charge generation layer forming liquid No. 4–1 was replaced with the pigment No. 47, whereby a photoconductor No. 4–4 according to the present invention was prepared.

COMPARATIVE EXAMPLE 4–2

Example 4—4 was repeated except that polyethylene polyoxypropylene glycol was eliminated from the intermediate layer forming liquid employed in Example 4—4, whereby a comparative photoconductor No. 4–2 was prepared.

EXAMPLE 4–5

Example 4–2 was repeated except that the pigment No. 1 used in the charge generation layer forming liquid employed in Example 4–2 was replaced with the pigment No. 47, whereby a photoconductor No. 4–5 according to the present invention was prepared.

EXAMPLE 4–6

Example 4–3 was repeated except that the pigment No. 1 used in the charge generation layer forming liquid employed in Example 4–3 was replaced with the pigment No. 47, whereby a photoconductor No. 4–6 according to the present invention was prepared.

EXAMPLE 4–7

Example 4–1 was repeated except that polyethylene polyoxypropylene glycol used in the intermediate layer forming liquid No. 4–1 was replaced with polyoxyethylene polyoxypropylene glycol (Trademark "Newpol 75H 90000", a random copolymer, made by Sanyo Chemical Industries, Ltd.), whereby a photoconductor No. 4–7 according to the present invention was prepared.

EXAMPLE 4–8

Example 4–2 was repeated except that polyethylene glycol monocarboxylate used in the intermediate layer forming liquid employed in Example 4–2 was replaced with polyoxyethylene sorbitan monooleate (Trademark "Ionet T-80C" made by Sanyo Chemical Industries, Ltd.), whereby a photoconductor No. 4–8 according to the present invention was prepared.

EXAMPLE 4–9

Example 4–3 was repeated except that polypropylene glycol monoether used in the intermediate layer forming liquid employed in Example 4–3 was replaced with polyoxyethylene polyoxyrypropylene glycol monoether (Trademark "Newpol 50HB-100" made by Sanyo Chemical Industries, Ltd.), whereby a photoconductor No. 4–9 according to the present invention was prepared.

EXAMPLE 4–10

Example 4–1 was repeated except that the protective layer forming liquid No. 4–1 was replaced with a protective layer forming liquid prepared in the following manner, whereby a photoconductor No. 4–10 according to the present invention was prepared.

Preparation of Protective Layer Forming Liquid

The following components were dispersed in a ball mill pot for 72 hours, and the resulting dispersion was diluted with cyclohexanone, thereby obtaining a protective layer forming liquid containing 10 wt.% of the solid components.

| | parts by weight |
|---|---|
| 20% Cyclohexane solution of phenoxy resin "PKHJ" (Trademark) made by Union Carbide Corp. | 25 |
| Tin oxide powder | 5 |
| Cyclohexanone | 70 |

EXAMPLE 4–11

Example 4–2 was repeated except that the protective layer forming liquid employed in Example 4–2 was replaced with a protective layer forming liquid prepared in the following manner, whereby a photoconductor No. 4–11 according to the present invention was prepared.

Preparation of Protective Layer Forming Liquid

The following components were dispersed in a ball mill for 72 hours, and the resulting dispersion was diluted with cyclohexanone, thereby obtaining a protective layer forming liquid containing 10 wt.% of the solid components.

| | parts by weight |
|---|---|
| 20% Cyclohexane solution of phenoxy resin "PKHJ" (Trademark) made by Union Carbide Corp. | 25 |
| Tin oxide powder | 5 |
| Cyclohexanone | 70 |

EXAMPLE 4–12

Example 4–3 was repeated except that the protective layer forming liquid employed in Example 4–3 was replaced with a protective layer forming liquid prepared in the following manner, whereby a photoconductor No. 4–12 according to the present invention was prepared.

Preparation of Protective Layer Forming Liquid

The following components were dispersed in a ball mill for 72 hours, and the resulting dispersion was diluted with cyclohexanone, thereby obtaining a protective layer forming liquid containing 10 wt.% of the solid components.

| | parts by weight |
|---|---|
| 20% Cyclohexane solution of phenoxy resin "PKHJ" (Trademark) made by Union Carbide Corp. | 25 |
| Tin oxide powder | 5 |
| Cyclohexanone | 70 |

COMPARATIVE EXAMPLE 4–3

Example 4—4 was repeated except that polyethylene polyoxypropylene glycol was eliminated from the intermediate layer forming liquid employed in Example 4—4, whereby a comparative photoconductor No. 4–3 was prepared.

EXAMPLE 4–13

Example 4–10 was repeated except that the intermediate layer forming liquid employed in Example 4–10 was replaced with an intermediate layer forming liquid having the following formulation, whereby a photoconductor No. 4–13 according to the present invention was prepared.

Formulation of Intermediate Layer Forming Liquid

| | parts by weight |
|---|---|
| Nylon resin | 2 |

-continued

| | parts by weight |
|---|---|
| (Trademark "CM8000" made by Toray Industries, Inc.) | |
| Polyethylene polyoxypropylene glycol (Trademark "Newpol PE68", a block copolymer, made by Sanyo Chemical Industries, Ltd.) | 0.02 |
| Methanol | 60 |
| Butanol | 38 |

EXAMPLE 4–14

Example 4–11 was repeated except that the intermediate layer forming liquid employed in Example 4–11 was replaced with an intermediate layer forming liquid having the following formulation, whereby a photoconductor No. 4–14 according to the present invention was prepared.

Formulation of Intermediate Layer Forming Liquid

| | parts by weight |
|---|---|
| Nylon resin (Trademark "CM8000" made by Toray Industries, Inc.) | 2 |
| Polyethylene polyoxypropylene glycol (Trademark "Ionet MS1000" made by Sanyo Chemical Industries, Ltd.) | 0.02 |
| Methanol | 60 |
| Butanol | 38 |

EXAMPLE 4–15

Example 4–12 was repeated except that the intermediate layer forming liquid employed in Example 4–12 was replaced with an intermediate layer forming liquid having the following formulation, whereby a photoconductor No. 4–15 according to the present invention was prepared.

Formulation of Intermediate Layer Forming Liquid

| | parts by weight |
|---|---|
| Nylon resin (Trademark "CM8000" made by Toray Industries, Inc.) | 2 |
| Polypropylene glycol monoether (Trademark "Newpol LB65" made by Sanyo Chemical Industries, Ltd.) | 0.02 |
| Methanol | 60 |
| Butanol | 38 |

COMPARATIVE EXAMPLE 4–4

Example 4–13 was repeated except that polyethylene polyoxypropylene glycol was eliminated from the intermediate layer forming liquid prepared in Example 4–13, whereby a comparative photoconductor No. 4'4 was prepared.

The electrophotographic properties of the above-prepared electrophotographic photoconductors Nos. 4–1 through 4–15 according to the present invention and the comparative ones Nos. 4–1 and 4—4 were each evaluated using an electrostatic paper analyzer (Trademark "SP-428", made by Kawaguchi Electro Works) in the following manner.

Each of the above electrophotographic photoconductors was positively charged in the dark under application of +6 kV of corona charge for 20 seconds. The surface potential of the photoconductor $V_2$, 2 seconds after the initiation of the charging, was measured by the paper analyzer. The photoconductor was then allowed to stand in the dark without applying any charge thereto until its surface potential reached +800 V. The photoconductor was then illuminated by a tungsten lamp in such a manner that the illuminance on the illuminated surface of the photoconductor was 4.5 lux, so that the exposure S (lux·sec) required to reduce the surface potential (+800 V) to +400 V was measured.

The photoconductor was then exposed to a tungsten light having a color temperature of 2856° K with an exposure of 100,000 lux·sec, and the surface potential $V_2'$ and the exposure S' were measured again in the same manner as mentioned above.

The results are shown in Table 4–1.

TABLE 4-1

| Photo-conductor | Before Fatigue | | After Fatigue | |
|---|---|---|---|---|
| | $V_2$ (V) | S (lux · sec) | $V_2'$ (V) | S' (lux · sec) |
| No. 4-1 | 781 | 0.81 | 788 | 0.83 |
| No. 4-2 | 821 | 0.81 | 830 | 0.82 |
| No. 4-3 | 771 | 0.82 | 736 | 0.81 |
| No. 4-4 | 793 | 0.75 | 800 | 0.76 |
| No. 4-5 | 833 | 0.75 | 842 | 0.76 |
| No. 4-6 | 761 | 0.85 | 725 | 0.83 |
| No. 4-7 | 693 | 0.85 | 647 | 0.82 |
| No. 4-8 | 821 | 0.86 | 806 | 0.82 |
| No. 4-9 | 761 | 0.85 | 725 | 0.83 |
| No. 4-10 | 782 | 0.80 | 789 | 0.82 |
| No. 4-11 | 822 | 0.80 | 831 | 0.80 |
| No. 4-12 | 772 | 0.81 | 739 | 0.81 |
| No. 4-13 | 802 | 0.79 | 808 | 0.81 |
| No. 4-14 | 842 | 0.79 | 851 | 0.80 |
| No. 4-15 | 792 | 0.79 | 757 | 0.77 |
| Comp. No. 4-1 | 728 | 0.81 | 385 | 0.79 |
| Comp. No. 4-2 | 740 | 0.75 | 347 | 0.73 |
| Comp. No. 4-3 | 729 | 0.80 | 436 | 0.75 |
| Comp. No. 4-4 | 651 | 0.89 | 358 | 0.89 |

The photoconductor was attached to the surface of an Al drum having a thickness of 3 mm and a size of 80ϕ×340 mm. This was placed in a copying machine (Trademark "FT 4060" made by Ricoh Company Ltd.), and images were repeatedly printed. The images were usually observed at the outset of printing and after 10,000 prints had been made. The results are shown in Table 4–2.

TABLE 4-2

| Photo-conductor | Printed Images at Outset of Printing | Printed Images after 10,000-time Printing |
|---|---|---|
| No. 4-1 | clear | clear |
| No. 4-2 | clear | clear |
| No. 4-3 | clear | clear |
| No. 4-4 | clear | clear |
| No. 4-5 | clear | clear |
| No. 4-6 | clear | clear |
| No. 4-7 | clear | clear |
| No. 4-8 | clear | clear |
| No. 4-9 | clear | clear |
| No. 4-10 | clear | clear |
| No. 4-11 | clear | clear |
| No. 4-12 | clear | clear |
| No. 4-13 | clear | clear |
| No. 4-14 | clear | clear |
| No. 4-15 | clear | clear |
| Comp. | clear | Image density was |

TABLE 4-2-continued

| Photo-conductor | Printed Images at Outset of Printing | Printed Images after 10,000-time Printing |
|---|---|---|
| No. 4-1 | | found low |
| Comp. No. 4-2 | clear | Image density was found low |
| Comp. No. 4-3 | clear | Image density was found low |
| Comp. No. 4-4 | clear | Image density was found low |

The results of the above tests demonstrate that the electrophotographic photoconductors according to the present invention, which comprise an intermediate layer containing the polyethylene glycol, have high sensitivity, and show extremely small reduction in the chargeability caused by pre-exposure fatigue. Furthermore, the photoconductors of the present invention bring about no delay in the rise of the charged potential and a minimized change in the residual electric potential even after repeated charging and exposing.

What is claimed is:

1. An electrophotographic photoconductor comprising an electroconductive support, a photoconductive layer formed on said electroconductive support, and an overcoat layer formed on said photoconductive layer, wherein said overcoat layer comprises a binder resin and one component selected from the group consisting of a crown ether, a polyalkylene glycol of molecular weight 100 or greater, a polyalkylene glycol ester and a polyalkylene glycol ether of molecular weight 322 or greater.

2. The electrophotographic photoconductor as claimed in claim 1, wherein the amount of said crown ether in said overcoat layer is in the range of 0.01 to 10 parts by weight to 1 par by weight of said binder resin.

3. The electrophotographic photoconductor as claimed in claim 1, wherein the amount of said polyalkylene glycol in said overcoat layer is in the range of 0.01 to 10 parts by weight to 1 part by weight of said binder resin.

4. The electrophotographic photoconductor as claimed in claim 1, wherein the amount of said polyalkylene glycol ester in said overcoat layer is in the range of 0.01 to 10 parts by weight to 1 part by weight of said binder resin.

5. The electrophotographic photoconductor as claimed in claim 1, wherein the amount of said polyalkylene glycol ether in said overcoat layer is in the range of 0.01 to 10 parts by weight to 1 part by weight of said binder resin.

6. The electrophotographic photoconductor as claimed in claim 1, wherein said overcoat layer further comprises finely-divided particles of a metallic oxide.

7. The electrophotographic photoconductor as claimed in claim 6, wherein the particle size of said metallic oxide is 0.5 μm or less.

8. The electrophotographic photoconductor as claimed in claim 6, wherein the amount of said metallic oxide is 10 to 80 wt. μof the entire weight of said overcoat layer.

9. The electrophotographic photoconductor as claimed in claim 6, wherein said metallic oxide is selected from the group consisting of $SnO_2$, $Sb_2O_3$, $In_2O_3$, and $TiO_2$.

10. The electrophotographic photoconductor as claimed in claim 1, wherein said overcoat layer has a thickness of 1 μm to 30 μm.

11. The electrophotographic photoconductor as claimed in claim 1, wherein said photoconductive layer comprises a charge generation layer and a charge transport layer.

12. The electrophotographic photoconductor as claimed in claim 1, wherein said crown ether is selected from the group consisting of benzo-9-crown-3-ether, 12-crown-4-ether, 18-crown-6-ether, dibenzo-18-crown-6-ether, tetrabenzo-24-crown-8-ether, 15-crown-5-ether, 21-crown-7-ether, benzo-15-crown-5-ether, dibenzo-24-crown-8-ether, dicyclohexano-24-crown-8-ether, poly(dibenzo-18-crown-6-ether) and a crown ether having the following formula:

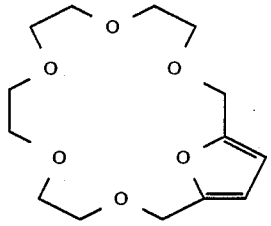

13. The electrophotographic photoconductor as claimed in claim 1, wherein said polyalkylene glycol is selected from the group consisting of polyethylene glycol, polypropylene glycol, polybutylene glycol, a random copolymer of hydroxyethylene and hydroxypropylene, and a block copolymer of hydroxyethylene and hydroxypropylene.

14. The electrophotographic photoconductor as claimed in claim 13, wherein said polyethylene glycol has a molecular weight ranging from 100 to 5,000,000.

15. The electrophotographic photoconductor as claimed in claim 13, wherein said polypropylene glycol has a molecular weight ranging from 130 to 500,000.

16. The electrophotographic photoconductor as claimed in claim 13, wherein said polybutylene glycol has a molecular weight ranging from 160 to 100,000.

17. The electrophotographic photoconductor as claimed in claim 13, wherein said random copolymer of hydroxyethylene and hydroxypropylene has a molecular weight ranging from 200 to 500,000.

18. The electrophotographic photoconductor as claimed in claim 13, wherein said block copolymer of hydroxyethylene and hydroxypropylene has a molecular weight ranging from 200 to 500,000.

19. The electrophotographic photoconductor as claimed in claim 1, wherein said polyalkylene glycol ester is selected from the group consisting of a polyethylene glycol monocarboxylic acid ester, a polyethylene glycol dicarboxylic acid ester and a carboxylic acid ester of polyoxyethylene sorbitan.

20. The electro-photographic photoconductor as claimed in claim 1, wherein said polyalkylene glycol ether is selected from the group consisting of a polyethylene glycol monoether, a polypropylene glycol monoether and a monoether of a copolymer of hydroxyethylene and hydroxypropylene.

21. The electrophotographic photoconductor as claimed in claim 20, wherein said polyethylene glycol monoether has the formula:

$$R—O—CH_2CH_2O_nH$$

wherein R represents an alkyl group having 1 to 30 carbon atoms, or a phenyl group having as a substituent an alkyl group having 1 to 20 carbon atoms; and n is an integer of 2 to 1 000.

22. The electrophotographic photoconductor as claimed in claim 20, wherein said polypropylene glycol monoether has the formula:

$$R—O—C_3H_bO_nH$$

wherein R represents an alkyl group having 1 to 30 carbon atoms, or a phenyl group having as a substituent an alkyl group having 1 to 20 carbon atoms; and n is an integer of 5 to 100.

23. The electrophotographic photoconductor as claimed in claim 20, wherein said monoether of the copolymer of hydroxyethylene and hydroxypropylene has a molecular weight of 200 to 20,000.

24. The electrophotographic photoconductor as claimed in claim 1, wherein said overcoat layer comprises an intermediate layer formed on said electroconductive support, and a protective layer formed on said intermediate layer, said intermediate layer comprising a binder resin and one component selected from the group consisting of a crown ether, a polyalkylene glycol of molecular weight 100 or greater, a polyalkylene glycol ester and a polyalkylene glycol ether of molecular weight 322 or greater.

25. The electrophotographic photoconductor as claimed in claim 24, wherein the amount of said crown ether in said intermediate layer is in the range of 0.1 to 50 parts by weight to 100 parts by weight of said binder resin.

26. The electrophotographic photoconductor as claimed in claim 24, wherein the amount of said polyalkylene glycol in said intermediate layer is in the range of 0.1 to 50 parts by weight to 100 parts by weight of said binder resin.

27. The electrophotographic photoconductor as claimed in claim 24, wherein the amount of said polyalkylene glycol ester in said intermediate layer is in the range of 0.1 to 50 parts by weight to 100 parts by weight of said binder resin.

28. The electrophotographic photoconductor as claimed in claim 24, wherein the amount of said polyalkylene glycol ether in said intermediate layer is in the range of 0.1 to 50 parts by weight to 100 parts by weight of said binder resin.

29. The electrophotographic photoconductor as claimed in claim 24, wherein said protective layer further comprises finely-divided particles of a metallic oxide.

30. The electrophotographic photoconductor as claimed in claim 29, wherein the particle size of said metallic oxide is 0.5 $\mu$m or less.

31. The electrophotographic photoconductor as claimed in claim 29, wherein the amount of said metallic oxide is 10 to 80 wt. % of the entire weight of said protective layer.

32. The electrophotographic photoconductor as claimed in claim 29, wherein said metallic oxide is selected from the group consisting of $SnO_2$, $Sb_2O_3$, $In_2O_3$, and $TiO_2$.

33. The electrophotographic photoconductor as claimed in claim 24, wherein said photoconductive layer comprises a charge generation layer and a charge transport layer.

34. The electrophotographic photoconductor as claimed in claim 24, wherein said crown ether is selected from the group consisting of benzo-9-crown-3-ether, 12-crown-4-ether, 18-crown-6-ether, dibenzo-18-crown-6-ether, tribenzo-18-crown-6-ether, dicyclohexano-18-crown-6-ether, tetrabenzo-24-crown-8-ether, 15-crown-5-ether, 21-crown-7-ether, benzo-15-crown-5-ether, dibenzo-24-crown-8-ether, dicyclohexano-24-crown-8-ether, poly(dibenzo-18-crown-6ether) and a crown ether having the following formula:

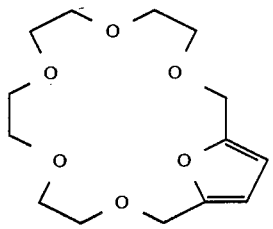

35. The electrophotographic photoconductor as claimed in claim 24, wherein said polyalkylene glycol is selected from the group consisting of polyethylene glycol, polypropylene glycol, polybutylene glycol, a random copolymer of hydroxyethylene and hydroxypropylene, and a block copolymer of hydroxyethylene and hydroxypropylene.

36. The electrophotographic photoconductor as claimed in claim 35, wherein said polyethylene glycol has a molecular weight ranging from 100 to 5,000,000.

37. The electrophotographic photoconductor as claimed in claim 35, wherein said polypropylene glycol has a molecular weight ranging from 130 to 500,000.

38. The electrophotographic photoconductor as claimed in claim 35, wherein said polybutylene glycol has a molecular weight ranging from 160 to 100,000.

39. The electrophotographic photoconductor as claimed in claim 35, wherein said random copolymer of hydroxyethylene and hydroxypropylene has a molecular weight ranging from 200 to 500,000.

40. The electrophotographic photoconductor as claimed in claim 35, wherein said block copolymer of hydroxyethylene and hydroxypropylene has a molecular weight ranging from 200 to 500,000.

41. The electrophotographic photoconductor as claimed in claim 24, wherein said polyalkylene glycol ester is selected from the group consisting of a polyethylene glycol monocarboxylic acid ester, a polyethylene glycol dicarboxylic acid ester and a carboxylic acid ester of polyoxyethylene sorbitan.

42. The electrophotographic photoconductor as claimed in claim 24, wherein said polyalkylene glycol ether is selected from the group consisting of a polyethylene glycol monoether, a polypropylene glycol monoether and a monoether of a copolymer of hydroxyethylene and hydroxypropylene.

43. The electrophotographic photoconductor as claimed in claim 42, wherein said polyethylene glycol monoether has the formula:

$$R—O—CH_2CH_2O_nH$$

wherein R represents an alkyl group having 1 to 30 carbon atoms, or a phenyl group having as a substituent an alkyl group having 1 to 20 carbon atoms; and n is an integer of 2 to 1,000.

44. The electrophotographic photoconductor as claimed in claim 42, wherein said polypropylene glycol monoether has the formula:

$$R—O—(C_3H_6O)_n—H$$

wherein R represents an alkyl group having 1 to 30 carbon atoms, or a phenyl group having as a substituent an alkyl group having 1 to 20 carbon atoms; and n is an integer of 5 to 100.

45. The electrophotographic photoconductor as claimed in claim 24, wherein said intermediate layer has a thickness of 10 μm or less and said protective layer has a thickness ranging from 1 μm to 30 μm.

* * * * *

UNITED STATES PATENT AND TRADEMARK OFFICE

CERTIFICATE OF CORRECTION

PATENT NO. : 4,970,131

DATED : 11/13/90

INVENTOR(S) : Kyoshi Taniguchi, et al.

It is certified that error appears in the above-identified patent and that said Letters Patent is hereby corrected as shown below:

Column 1, line 63, "$SiO_2$ $Al_2O_3$ 3 and B4C" should read

--$SiO_2$, $Al_2O_3$ and $B_4C$--.

Column 3, line 7, "3 t 8" should read --3 to 8--.

Column 44, line 61, after "minutes" add a period --.--

Column 45, lines 7-8, "dibenzo18-crown-6-ether" should read

--dibenzo-18-crown-6-ether--.

Column 46, line 49, before "Trademark" add a parenthesis --(--

Column 48, line 16, "EXAMPLE -7" should read --EXAMPLE 2-7--.

Column 49, line 10, "2-13" should read --EXAMPLE 2-13--.

Column 51, line 30, before "Trademark" add a parenthesis --(--

Column 51, line 67, "fallowed" should read --followed--.

Column 54, line 5, "1856°" should read --2856°--.

Column 55, line 22, before "Trademark" add a parenthesis --(--

Column 59, line 60, "4'4" should read --4-4--.

Column 61, line 60, "wt. μof" should read --wt. % of--.

UNITED STATES PATENT AND TRADEMARK OFFICE

CERTIFICATE OF CORRECTION

PATENT NO. : 4,970,131

DATED : 11/13/90

INVENTOR(S) : Kiyoshi Taniguchi, et al.

It is certified that error appears in the above-identified patent and that said Letters Patent is hereby corrected as shown below:

Column 62, line 9, after "crown-6-ether," please insert --tribenzo-18-crown-6-ether,dicyclohexano-18-crown-6-ether,--.

Column 62, line 57, "electro-photographic" should read -electrophotographic--.

Column 62, line 67, "R--O--$CH_2CH_2O_nH$" should read --R-O-$(CH_2CH_2O)_n$-H--.

Column 63, line 7, "R—O—$C_3H_bO_nH$" should read --R-O—$(C_3H_6O)_n$—H--.

Column 64, line 63, R—O—$CH_2CH_2O_nH$" should read --R-O-$(CH_2CH_2O)_n$-H--.

Signed and Sealed this

Sixth Day of April, 1993

*Attest:*

STEPHEN G. KUNIN

*Attesting Officer*

*Acting Commissioner of Patents and Trademarks*